US007859949B2

(12) United States Patent
Kitahara et al.

(10) Patent No.: US 7,859,949 B2
(45) Date of Patent: Dec. 28, 2010

(54) TIMEPIECE

(75) Inventors: Joji Kitahara, Nagano-ken (JP); Shoichi Nagao, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 51 days.

(21) Appl. No.: 12/495,116

(22) Filed: Jun. 30, 2009

(65) Prior Publication Data

US 2010/0002545 A1 Jan. 7, 2010

(30) Foreign Application Priority Data

Jul. 2, 2008 (JP) ..... 2008-173845

(51) Int. Cl.
*G04B 19/20* (2006.01)

(52) U.S. Cl. ..... 368/37; 368/35

(58) Field of Classification Search ..... 368/28–40
See application file for complete search history.

(56) References Cited

U.S. PATENT DOCUMENTS

| | | | | |
|---|---|---|---|---|
| 2,976,672 | A * | 3/1961 | Ducommun | 368/37 |
| 3,779,001 | A * | 12/1973 | Kocher et al. | 368/38 |
| 3,982,388 | A * | 9/1976 | Guyot et al. | 368/35 |
| 6,574,167 | B2 * | 6/2003 | Weissbach et al. | 368/35 |
| 6,711,100 | B2 * | 3/2004 | Rochat et al. | 368/35 |
| 2007/0177464 | A1 * | 8/2007 | Watanabe | 368/37 |
| 2009/0154296 | A1 * | 6/2009 | Behling et al. | 368/10 |

FOREIGN PATENT DOCUMENTS

| | | |
|---|---|---|
| JP | 5-281368 | 10/1993 |

* cited by examiner

*Primary Examiner*—Vit W Miska
*Assistant Examiner*—Sean Kayes
(74) *Attorney, Agent, or Firm*—Mark P. Watson

(57) ABSTRACT

A timepiece includes a dial having a tens date display window for displaying the tens digit of the date, and a ones date display window for displaying the ones digit of the date; and a calendar mechanism having a tens indicator wheel to which a plurality of tens digit markers are disposed and a ones indicator wheel to which a plurality of ones digit markers are disposed, and which displays one of the plural tens digit markers disposed to the tens indicator wheel from the tens date display window, and displays one of the plural ones digit markers disposed to the ones indicator wheel from the ones date display window. The ones indicator wheel has a ones indicator plate on which the ones digit markers are disposed, and a ones indicator pinion affixed to the ones indicator plate. The tens indicator wheel has a tens indicator plate on which the tens digit markers are disposed, and a tens indicator pinion affixed to the tens indicator plate. The ones indicator pinion is a ring-shaped external tooth wheel having external teeth formed on the outside circumference surface. The tens indicator pinion and a tens intermediate wheel that meshes with and transfers drive power to the tens indicator pinion are disposed in the space on the inside circumference side of the ones indicator pinion.

7 Claims, 13 Drawing Sheets

TIMEPIECE

CROSS-REFERENCE TO RELATED APPLICATIONS

Japanese Patent application No. 2008-173845, filed Jul. 2, 2008, is hereby incorporated by reference in its entirety.

BACKGROUND

1. Field of Invention

The present invention relates to a timepiece that has a calendar mechanism for displaying the date.

2. Description of Related Art

Timepieces that have a calendar mechanism for displaying the date in the dial are known from the literature. Timepieces that are constructed to separately drive a ones date ring on which the ones digit of the date is printed and a tens date ring on which the tens digit of the date is printed in order to display the date with larger numbers are also known from the literature. See, for example, Japanese Patent 2503347.

The timepiece taught in Japanese Patent 2503347 has a ones digit wheel that has the numbers 0 to 9 for displaying the ones digit of the date printed at equal intervals on one side, and a tens digit wheel that is supported rotatably above the ones digit wheel and has the numbers 1 to 3 and a blank space for displaying the tens digit of the date provided on one side. The ones digit wheel is a circular ring and has an internal tooth ring formed along the inside circumference. A pinion (tens digit wheel pinion) is disposed in unison with the rotating shaft of the tens digit wheel.

A hand shaft for moving the hour and minute hands is disposed inside of the ones digit wheel. Also disposed inside the ones digit wheel are various wheels, such as an intermediate wheel, program drive wheel, ones program drive wheel, and tens program drive wheel, for transferring drive power from the hand shaft to the internal tooth ring of the ones digit wheel and the pinion of the tens digit wheel.

The timepiece taught in Japanese Patent 2503347 thus has various wheels for driving the ones digit wheel and various wheels for driving the tens digit wheel disposed inside the ones digit wheel. The inside diameter of the ones digit wheel must therefore be increased in order to accommodate these other wheels, thus reducing the size of the area available for printing the ones digits and preventing sufficiently increasing the size of the digits used to display the date.

A configuration rendering a gear with external teeth to the ones digit wheel (a ones digit wheel pinion) to increase the surface area for displaying the ones digits is also conceivable. However, the ones digit wheel must be positioned so that there is no interference between the ones date indicator, the tens date indicator, and the tens intermediate wheel that relays drive power to the ones date indicator and the tens date indicator, these wheels must be disposed overlapping vertically through the thickness of the timepiece, and the thickness of the timepiece is thus increased.

SUMMARY OF INVENTION

A timepiece according to the present invention enables displaying large numbers in the calendar mechanism while maintaining a thin timepiece profile.

A first aspect of the invention is a timepiece having a dial having a tens date display window for displaying the tens digit of the date, and a ones date display window for displaying the ones digit of the date; and a calendar mechanism having a tens indicator wheel to which a plurality of tens digit markers are disposed and a ones indicator wheel to which a plurality of ones digit markers are disposed, and which displays one of the plural tens digit markers disposed to the tens indicator wheel from the tens date display window, and displays one of the plural ones digit markers disposed to the ones indicator wheel from the ones date display window. The ones indicator wheel having a ones indicator plate on which the ones digit markers are disposed, and a ones indicator pinion affixed to the ones indicator plate; the tens indicator wheel having a tens indicator plate on which the tens digit markers are disposed, and a tens indicator pinion affixed to the tens indicator plate; the ones indicator pinion being a ring-shaped external tooth wheel having external teeth formed on the outside circumference surface; and the tens indicator pinion and a tens intermediate wheel that meshes with and transfers drive power to the tens indicator pinion being disposed in the space on the inside circumference side of the ones indicator pinion.

In this aspect of the invention the ones indicator pinion is a ring-shaped external tooth wheel, and the tens indicator pinion and tens intermediate wheel are located on the inside circumference side of this ones indicator pinion.

By using an external tooth wheel as the ones indicator pinion, this aspect of the invention can increase the area of the part of the ones indicator plate where the ones digit markers are disposed. More specifically, when the ones indicator plate is ring shaped and internal teeth are formed around the inside circumference edge of the ones indicator plate as in the related art, the ones intermediate wheel for driving the ones indicator wheel, the tens indicator pinion disposed in unison with the tens indicator wheel, the tens intermediate wheel that transfers drive power to the tens indicator pinion, and the control wheel that controls driving the ones intermediate wheel and the tens intermediate wheel must be disposed on the inside circumference side of this internal teeth wheel. When numerous wheels are thus disposed on the inside circumference side of the internal teeth wheel of ones indicator wheel, the diameter of the internal teeth wheel must be increased in order to provide enough space to accommodate these other wheels. The area of the surface on which the ones digit markers of the ones indicator plate are disposed is thus reduced, and the display size of the ones digit markers becomes smaller.

However, because the ones indicator pinion of the invention is an external tooth wheel, the ones intermediate wheel and the control wheel can be disposed on the outside of the ones indicator pinion, the diameter of the ones indicator pinion can be reduced, and the area of the surface of the ones indicator plate on which the ones markers are disposed is larger. Therefore, the display size of the ones digit markers can be increased. As a result, a calendar mechanism that can display the date using larger numerals can be provided.

Furthermore, the ones indicator pinion is ring shaped, and the tens intermediate wheel and the tens indicator pinion are disposed on the inside circumference side of the ones indicator pinion. Therefore, the ones indicator pinion and the tens indicator pinion and tens intermediate wheel can be disposed at the same height in the timepiece thickness direction. As a result, an increase in the timepiece thickness can be suppressed and a thinner design can be achieved compared with a configuration in which the ones indicator pinion and the tens indicator pinion and tens intermediate wheel are disposed at different elevations in the timepiece thickness direction.

In a timepiece according to another aspect of the invention the axis of rotation of the ones indicator wheel is preferably disposed to an eccentric position located in a specific direction from the axis of rotation of the tens indicator wheel.

Note that the axis of rotation as used herein does not refer to a physical shaft member, and means an imaginary line through the center of rotation perpendicular to the rotating surface.

In this aspect of the invention the ones indicator wheel is disposed eccentrically in a specific direction of eccentricity. Preferably, the ones indicator wheel is disposed eccentrically in the direction that the tens intermediate wheel is disposed relative to the axis of rotation of the tens indicator wheel.

Further preferably, the axis of rotation of the ones indicator wheel and the axis of rotation of the tens indicator wheel are disposed eccentrically on the direction joining approximately three o'clock and approximately nine o'clock. For example, the axis of rotation of the ones indicator wheel is offset approximately to three o'clock from the axis of rotation of the tens indicator wheel, or in the opposite direction towards approximately nine o'clock.

FIGS. 1A and 1B and FIGS. 2A and 2B show the difference in the inside diameter of the ones indicator pinion according to the locations of the ones indicator wheel, the tens indicator wheel, and the tens intermediate wheel. FIG. 1A and FIG. 2A show the configuration when the axis of rotation of the ones indicator wheel and the axis of rotation of the tens indicator wheel are concentric to the axis of rotation of the hand shaft. FIG. 1B and FIG. 2B show the configuration when the axis of rotation of the ones indicator wheel is set a specific distance eccentrically to the tens intermediate gear side.

As shown in FIG. 1A and FIG. 2A, if the inside circumference radius of the ones indicator pinion 113 is L1, the radius of the tens indicator pinion 123 is L2, and the radius of the tens intermediate wheel 180 is L3 when the axis of rotation of the tens indicator wheel 120 and the axis of rotation of the ones indicator wheel 110 are concentric to the axis of rotation O of the hand shaft, L1>L2+(L3*2) must be true in order to prevent the tens indicator pinion 123 and tens intermediate wheel 180 from contacting the inside circumference surface of the ones indicator pinion 113. More specifically, the inside circumference radius L1 of the ones indicator pinion 113 must be greater than the sum of the radius L2 of the tens indicator pinion 123 and the diameter (L3*2) of the tens intermediate wheel.

In contrast, as shown in FIG. 1B and FIG. 2B, if the axis of rotation of the ones indicator wheel 110 is disposed to a position (eccentric point P) that is eccentric by a specific distance to the tens intermediate wheel 180 side, the inside radius L4 of the ones indicator pinion 113 can be set so that the inside diameter (L4*2) of the ones indicator pinion 113 is greater than the sum of the diameter (L2*2) of the tens indicator pinion and the diameter (L3*2) of the tens intermediate wheel. More specifically, because L4*2>L2*2+L3*2, L4>L2+L3. Therefore, if the axis of rotation of the ones indicator wheel 110 is set eccentrically by a specific distance from the axis of rotation O of the hand shaft, the inside radius of the ones indicator pinion 113 can be reduced by L3 compared with a configuration in which the ones indicator wheel 110 and tens indicator wheel 120 are disposed concentrically.

As shown in FIG. 1A, if the outside diameter of the ones indicator plate 111 of the ones indicator wheel 110 is a specific preset diameter L5, the width L of the part of the ones indicator plate 111 where the ones digit markers can be disposed will be L<L5−(L2+(L3*2)) when the axes of rotation of the tens indicator wheel 120 and ones indicator wheel 110 are concentric because L<L5−L1. However, as shown in FIG. 1B if the axis of rotation of the ones indicator wheel is set eccentrically, L<L5−(L2+L3) because L<L5−L4. Therefore, the width of the surface on which the ones digit markers are disposed can be increased by L3 when the axis of rotation of the ones indicator wheel is set eccentrically, and the surface area of the ones indicator plate can be increased. As a result, larger ones digit markers can be provided.

Furthermore, as shown in FIG. 2A, in order to locate a ones indicator wheel 110 with the largest possible ones digit markers within a main plate 20 of a known preset diameter, a design that keeps the outside circumference edge of the ones indicator plate 111 from going outside the outside circumference edge of the main plate 20 is required. In this configuration the width L6 of the ones indicator wheel 110 in which the ones digit markers can be formed is substantially fixed. When the axes of rotation of the tens indicator wheel 120 and ones indicator wheel 110 are concentric, the radius L' from the axis of rotation of the ones indicator plate 111 to the outside circumference edge is L'=L1+L6=(L2+L3*2)+L6. In addition, when the axes of rotation of the tens indicator wheel 120 and ones indicator wheel 110 are eccentric, as shown in FIG. 2B, the radius L' from the axis of rotation of the ones indicator plate 111 to the outside circumference edge is L'=L4+L6=L2+L3+L6. Therefore, when the axis of rotation of the ones indicator wheel 110 is set eccentrically, the width L6 where the ones digit markers are formed can be held constant while the radius of the ones indicator wheel 110 itself can be reduced compared with a configuration in which the axes of rotation of the tens indicator wheel 120 and ones indicator wheel 110 are concentric. With this configuration the exposed area between the main plate 20 and dial 4 can be increased while the size of the numerals in the ones digit markers can be sustained. The available space can therefore be used effectively to place a shaft that supports a hand for indicating the day or month, for example, from the main plate 20 to the dial side.

A timepiece according to another aspect of the invention also has a hand that indicates time, and a hand shaft that supports the hand, and the axis of rotation of the hand shaft is disposed concentrically to the axis of rotation of the tens indicator wheel.

With this aspect of the invention the axis of rotation of the hand shaft is concentric to the axis of rotation of the tens indicator wheel. More specifically, if the axis of rotation of the hand shaft and the axis of rotation of the tens indicator wheel are not concentric, the hand shaft must be disposed to a position where it will not interfere with rotation of the tens indicator wheel. Yet more specifically, in order to prevent the tens indicator wheel from interfering with the hand shaft, the diameter of the tens indicator wheel must be set to less than the distance from the axis of rotation of the tens indicator wheel to the axis of rotation of the hand shaft, and the surface area of the tens indicator wheel thus decreases. The tens indicator wheel may conceivably be ring-shaped in order to pass the hand shaft therethrough, but this configuration increases the outside diameter of the tens indicator pinion and thus also increases the diameter of the ones indicator pinion.

However, by disposing the axis of rotation of the tens indicator wheel and the axis of rotation of the hand shaft concentrically, the diameter of the tens indicator plate can be increased without the hand shaft interfering with rotation of the tens indicator wheel. Furthermore, because the diameter of the ones indicator wheel can be reduced, the surface area for disposing the ones digit markers on the ones indicator plate can also be increased.

In a timepiece according to another aspect of the invention the tens date display window and the ones date display window are disposed in the dial at approximately the twelve o'clock direction or approximately the six o'clock direction from the axis of rotation of the hand shaft; and the axis of rotation of the ones indicator wheel is disposed to an eccentric position a specific distance from the axis of rotation of the hand shaft toward approximately the three o'clock position or approximately the nine o'clock position of the dial.

In this aspect of the invention the tens date display window and the ones date display window are disposed at approximately the twelve o'clock or approximately the six o'clock position of the timepiece. More specifically, because the tens date display window must be located on the left side of the ones date display window, one of the windows must be located on the inside circumference side of the other window (the side towards the hand shaft) if the tens date display window and the ones date display window are located near three o'clock or near nine o'clock. For example, if the display windows are disposed near three o'clock, the tens date display window must be located on the inside circumference side of the ones date display window. The diameter of the date indicator for the display window on the inside circumference side is therefore smaller, and the size of the numerals that can be displayed on the indicator become smaller.

However, because this aspect of the invention disposes the tens date display window and ones date display window near either the twelve o'clock position or the six o'clock position, it is not necessary to reduce the size of one of the corresponding ones indicator wheel or tens indicator wheel. The date indicators can therefore be rendered relatively large, the size of the numerals that can be displayed on the indicators can be large, and a so-called big date calendar mechanism can be achieved.

The axis of rotation of the ones indicator wheel is set eccentrically to one side either in the three o'clock direction or nine o'clock direction in the invention. As a result, the tens digit markers of the tens indicator wheel and the ones digit markers of the ones indicator wheel can be set in well balanced positions.

More specifically, when the ones indicator wheel is placed eccentrically in the direction of the date display window (the tens date display window and ones date display window), such as when the date display window is disposed near twelve o'clock and the ones indicator wheel is set to a position eccentric to the twelve o'clock direction, the entire ones indicator wheel is positioned shifted toward twelve o'clock. The ones date display window must therefore also be shifted toward the outside diameter of the timepiece. With this configuration, however, the date display window is pushed too close to the outside circumference edge of the timepiece, resulting in an unbalanced position and poor design. In addition, if the date display window is moved toward the center axis of the timepiece, the area in which the ones digit markers can be rendered becomes small.

Furthermore, if the ones indicator wheel is set eccentrically to the opposite side as the direction of the date display window, such as if the axis of rotation of the ones indicator wheel is offset towards six o'clock in a timepiece in which the ones date display window and tens date display window are disposed towards twelve o'clock, the entire ones indicator wheel gets shifted towards six o'clock and sufficient space for rendering the ones digit markers cannot be assured.

However, when the ones indicator wheel is set eccentrically in a direction intersecting the orientation of the ones date display window and the tens date display window, the positions of the outside edges of the ones indicator wheel and tens indicator wheel can substantially match along the orientation of the tens date display window and ones date display window. For example, in a timepiece in which the ones date display window and tens date display window are disposed near twelve o'clock, the ones indicator wheel will be disposed projecting towards three o'clock if the axis of rotation of the ones indicator wheel is shifted towards three o'clock, but the positions of the outside edges of the ones indicator wheel and tens indicator wheel will substantially match towards twelve o'clock and six o'clock. The ones digit markers and tens digit markers can also be rendered well balanced at suitable positions, and sufficient area for disposing these markers can be assured.

A timepiece according to another aspect of the invention preferably also has a hand that indicates time, and a hand shaft that supports the hand, and the hand shaft is disposed in a space on the inside circumference side of the ones indicator pinion and concentrically to the tens indicator pinion.

In this aspect of the invention the hand shaft is on the inside circumference side of the ones indicator pinion and is disposed concentrically to the tens indicator pinion. Because the hand shaft and the tens indicator pinion must be disposed to positions that do not interfere with the rotation of the other if the axis of rotation of the hand shaft and the axis of rotation of the tens indicator pinion are not concentric, the plane area of the timepiece increases. A configuration that does not change the plane area of the timepiece is conceivable, but because the dimension from the axis of rotation of the tens indicator wheel to the outside edge of the timepiece becomes smaller with such a configuration, the area of the tens indicator plate in which the tens digit markers can be disposed becomes smaller. However, because the configuration according to this aspect of the invention renders the hand shaft on the inside circumference side of the ones indicator pinion, the thickness of the timepiece can be thin, the plane area of the timepiece can be used effectively by rendering the axes of rotation of the hand shaft and the tens indicator pinion concentric, and a smaller timepiece can be achieved. In addition, the area of the tens indicator plate in which the tens digit markers are rendered does not become small and the size of the numerals used to display the date can be increased.

A timepiece according to another aspect of the invention further preferably has a ones intermediate wheel that meshes with the ones indicator pinion and transfers drive power to the ones indicator wheel, and a control wheel that transfers drive power from a date wheel drive power source to the tens intermediate wheel and the ones intermediate wheel. The control wheel is ring shaped with external teeth disposed to the outside circumference surface and internal teeth disposed to the inside circumference surface, the external teeth of the control wheel mesh with a pinion of the tens intermediate wheel, and the internal teeth of the control wheel mesh with a pinion of the ones intermediate wheel.

With this aspect of the invention the ones intermediate wheel is disposed on the outside of the ones indicator pinion. As a result, the ones intermediate wheel is disposed to a position not overlapping the tens intermediate wheel and the tens indicator pinion, and an increase in the thickness of the timepiece can be suppressed.

In addition, the external teeth of the control wheel mesh with the pinion of the tens intermediate wheel and the internal teeth of the control wheel mesh with the pinion of the ones intermediate wheel. If both a wheel that meshes with the pinion of the ones intermediate wheel and a wheel that meshes with the pinion of the tens intermediate wheel are disposed to either the outside circumference or the inside circumference of the control wheel, the thickness of the control wheel is increased, the ones intermediate wheel and the tens intermediate wheel must be disposed to different height positions (elevations), and the timepiece thickness increases. However, because the external teeth and the internal teeth can be rendered at the same height position (elevation) in this aspect of the invention, increasing the thickness of the control wheel can be prevented. In addition, the ones intermediate wheel and the tens intermediate wheel that mesh with this control wheel can be disposed at substantially the same height in the timepiece thickness direction, the thickness of the timepiece can be suppressed and a thinner timepiece can be achieved.

Furthermore, the axis of rotation of the control wheel as well as the axis of rotation of the ones intermediate wheel can be disposed on the outside of the ones indicator pinion.

More specifically, if the ones intermediate wheel is disposed on the outside of the ones indicator pinion, the internal teeth of the control wheel mesh with the pinion of this ones intermediate wheel, and the axis of rotation of the control wheel is disposed on the inside of the ones indicator pinion, the distance between the axis of rotation of the control wheel and the axis of rotation of the ones intermediate wheel will increase. This requires a design in which the inside diameter dimension from the axis of rotation of the control wheel to the internal teeth that mesh with the ones intermediate wheel is increased, and the diameter of the control wheel thus increases. In order to dispose the tens intermediate wheel inside the ones indicator pinion in this configuration, the diameter of the ones indicator pinion must be increased, and the area where the ones digit markers are disposed to the ones indicator plate may thus decrease.

Furthermore, when the hand shaft is disposed inside the ones indicator pinion, the control wheel must be positioned so that it does not interfere with the hand shaft, interference between the control wheel and the tens indicator pinion must also be avoided, and the positioning balance is poor. In addition, because these parts are concentrated on the inside of the ones indicator pinion, the timepiece thickness increases in order to avoid interference.

However, with the configuration according to this aspect of the invention in which the axis of rotation of the control wheel is outside of the ones indicator pinion, the axis of rotation of the ones intermediate wheel and the axis of rotation of the control wheel can be set in greater proximity, and the inside diameter dimension from the axis of rotation of the control wheel to the internal teeth that mesh with the ones intermediate wheel can be decreased. Therefore, the diameter of the control wheel becomes smaller and the size of the timepiece can be reduced. In addition, because there are no problems such as the diameter of the ones indicator pinion increasing, a sufficiently large area can be assured for rendering the ones digit markers on the ones indicator plate, the date can be displayed with large numerals, interference between parts can easily be avoided because the positioning of the timepiece parts is good, and a thin timepiece can be achieved.

A timepiece according to another aspect of the invention preferably has a hand drive power source that supplies drive power to drive the hand, and a date wheel drive power source that supplies drive power to drive the ones indicator wheel and the tens indicator wheel.

This aspect of the invention has a date wheel drive power source for driving the ones indicator wheel and the tens indicator wheel in addition to a hand drive power source that supplies drive power for driving the hands supported on the hand shaft. If the ones indicator wheel and the tens indicator wheel are driven using only the hand drive power source, a hand drive power source with high output power is required because drive power sufficient to drive the date indicators is needed in addition to the drive power required to drive the hands. Furthermore, if a high output drive power source is used, power consumption increases because the hands are driven constantly.

However, because this aspect of the invention provides a separate date wheel drive power source to drive the ones indicator wheel and tens indicator wheel, a low output power source that can supply only the drive power required to drive the hands can be used as the hand drive power source, and power consumption can be reduced.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of a timepiece according to the present invention is described below with reference to the accompanying figures.

Figure 3:
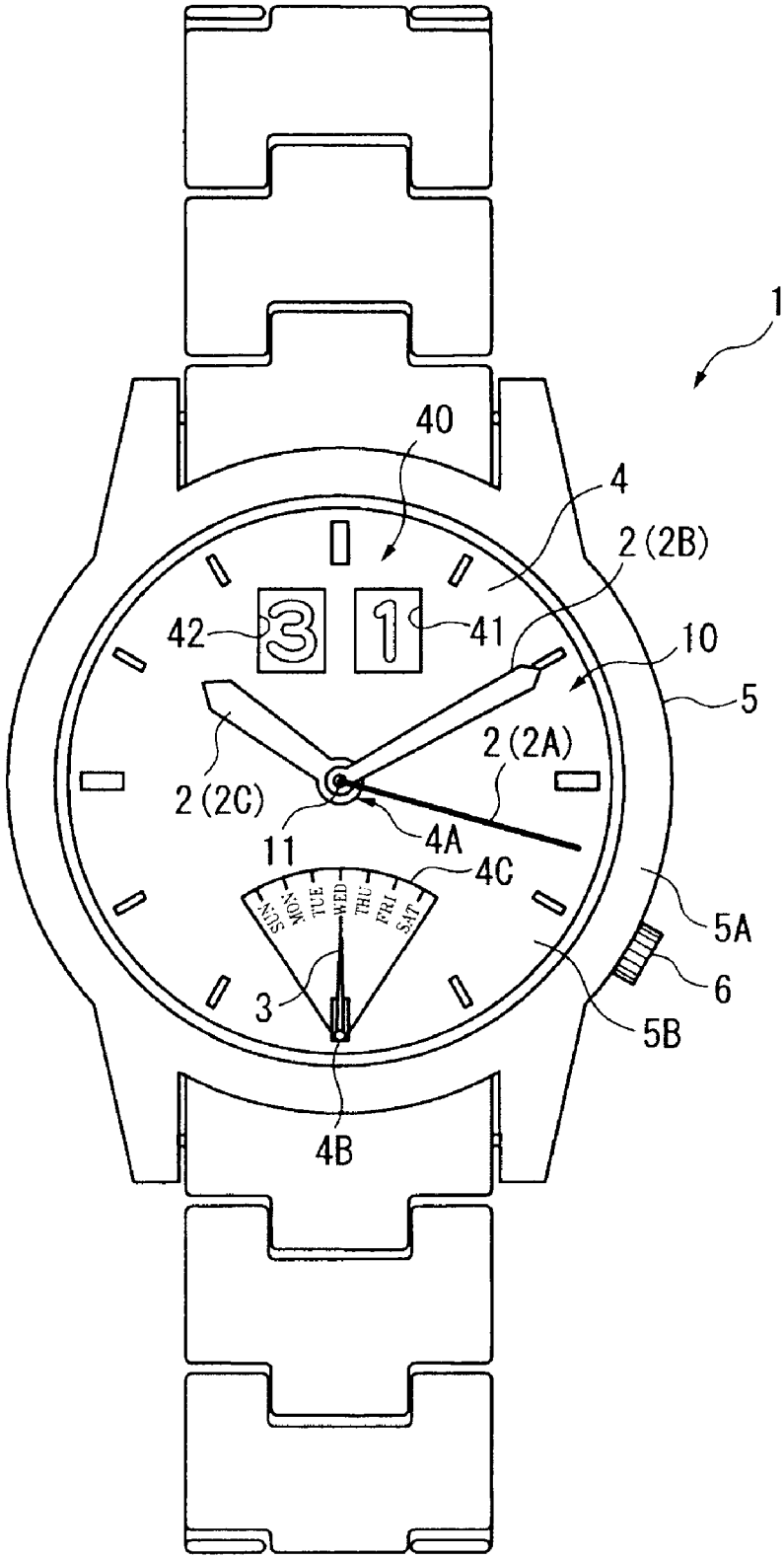
FIG. 3 is a front view of a timepiece according to a preferred embodiment of the invention.

FIG. 3 is a front view of a timepiece according to this preferred embodiment of the invention.

General Configuration

As shown in FIG. 3, a timepiece 1 according to this embodiment of the invention has hands 2 (second hand 2A, minute hand 2B, hour hand 2C) for displaying the time, a day hand 3 for indicating the weekday, a dial 4, a movement 10, and a case 5 inside of which the hands 2, day hand 3, dial 4, and movement 10 are disposed.

The case 5 includes a case body 5A, a back cover not shown, and a crystal 5B, and the dial 4 is disposed facing the crystal 5B. A center hole 4A through which the hand shaft 11 that supports the hands 2 passes is rendered in the center of the dial 4 (see FIG. 7, FIG. 8, FIG. 13), and the hands 2 are disposed supported by the hand shaft 11 between the dial 4 and the crystal 5B.

A crown 6 is disposed substantially at the four o'clock position of the timepiece 1.

Dial

The dial 4 is a round disk having twelve markers for displaying the time disposed equidistantly around the outside edge.

A calendar unit 40 is disposed near the twelve o'clock position of the dial 4. This calendar unit 40 has a ones digit window 41 in which the ones digit of the date is displayed, and a tens digit window 42 in which the tens digit of the date is displayed. As described in further detail below, a ones indicator wheel 110 (see FIG. 10) and a tens indicator wheel 120 (see FIG. 11) are disposed behind the dial 4. A ones date scale 111A having a plurality of ones digits (a ones digit scale) is printed around the ones indicator wheel 110. A tens date scale 121B having a plurality of tens markers (a tens digit scale) is printed on the tens indicator wheel 120. One of the plurality of ones digits of the date in the ones date scale 111A on the ones indicator wheel 110 is displayed in the ones digit window 41, and one of the plural tens digits of the date in the tens date scale 121B on the tens indicator wheel 120 is displayed in the tens digit window 42.

A day hand hole 4B through which the day hand shaft supporting the day hand 3 is passed is disposed near the six o'clock position of the dial 4. A fan-shaped day scale 4C on which the day hand 3 indicates the day of the week is also disposed on the dial 4. As shown in FIG. 3, a scale of markers indicating the days of the week at a specific angular interval centered on the day hand hole 4B is described on the day scale 4C. The day hand 3 points to one of these markers to indicate the current day of the week.

Movement

Figure 4:
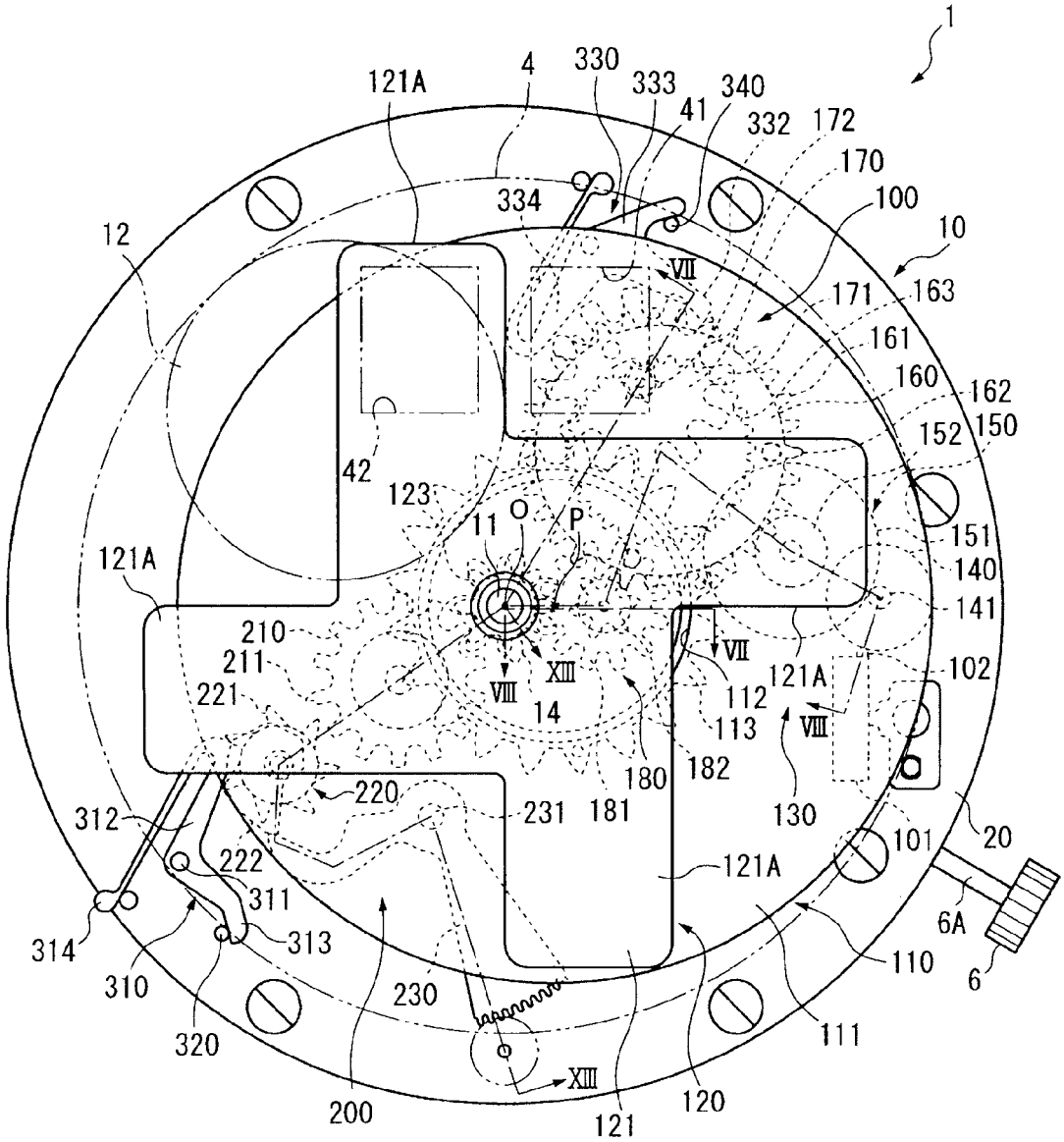
FIG. 4 is a plan view from the dial side schematically showing the configuration of the movement 10 of the timepiece.

FIG. 4 is a plan view from the dial side schematically showing the configuration of the movement 10 in this timepiece 1.

The movement 10 includes a hand drive mechanism not shown, a control circuit unit not shown, a battery 12, a calendar mechanism 100, a day hand drive mechanism 200, and a main plate 20 on which the hand drive mechanisms, control circuit unit, battery 12, calendar mechanism 100, and day hand drive mechanism 200 are disposed.

The hand drive mechanism is disposed on the back cover side of the main plate 20. This hand drive mechanism, not shown in the figures, is a common hand drive mechanism including a drive motor that is driven controlled by the control circuit unit, and a hand drive wheel train that transfers drive power from the drive motor to the hand shaft on which the hands are supported.

The control circuit unit is typically an integrated circuit device mounted on a circuit board that is disposed to the back cover side of the main plate 20. This control circuit unit, not shown in the figures, includes a control unit that controls the timepiece 1, a detection circuit that detects operation of the crown 6, for example, and a timekeeping unit including a crystal oscillator circuit for keeping the time and date. The control circuit unit is driven by power supplied from the battery 12, and outputs specific drive power to the drive motor of the hand drive mechanism and the actuator 101 of the calendar mechanism 100 as described below.

The battery 12 supplies a specific amount of power to the control circuit unit, the drive motor of the hand drive mechanism, and the actuator 101 of the calendar mechanism. The battery 12 is positioned midway between the nine o'clock and twelve o'clock positions (approximately at the ten o'clock position of the dial 4) when seen in the plane direction of the movement 10. Note that a solar cell panel may be disposed proximally to the dial 4, for example, and the battery 12 may be a storage battery that can be recharged by power produced by the solar battery panel.

Calendar Mechanism

Figure 5:
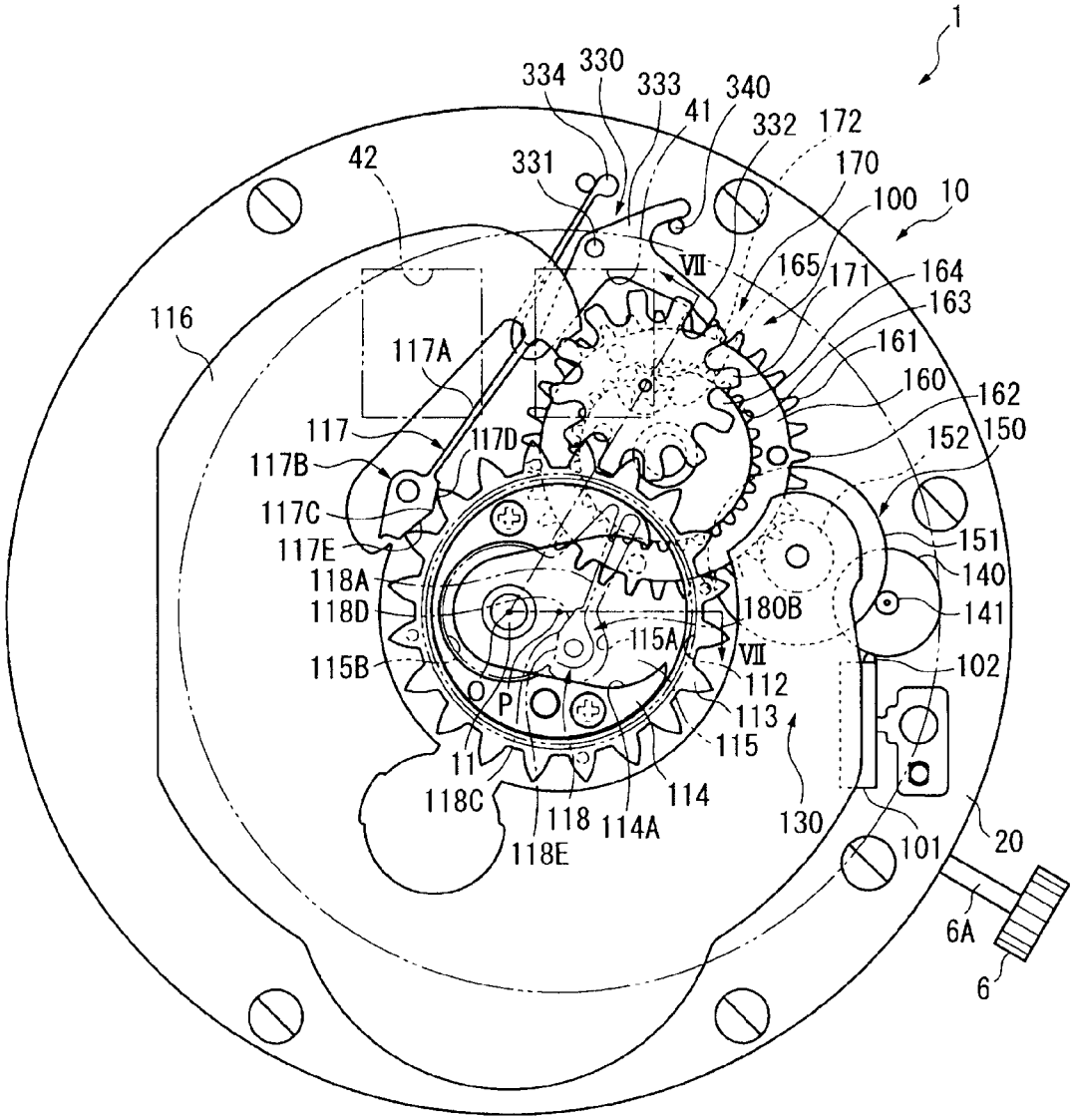
FIG. 5 is a plan view extracting the configuration for driving the ones intermediate wheel from FIG. 4.

FIG. 5 is a plan view showing the parts of the ones date indicator extracted from FIG. 4.

Figure 6:
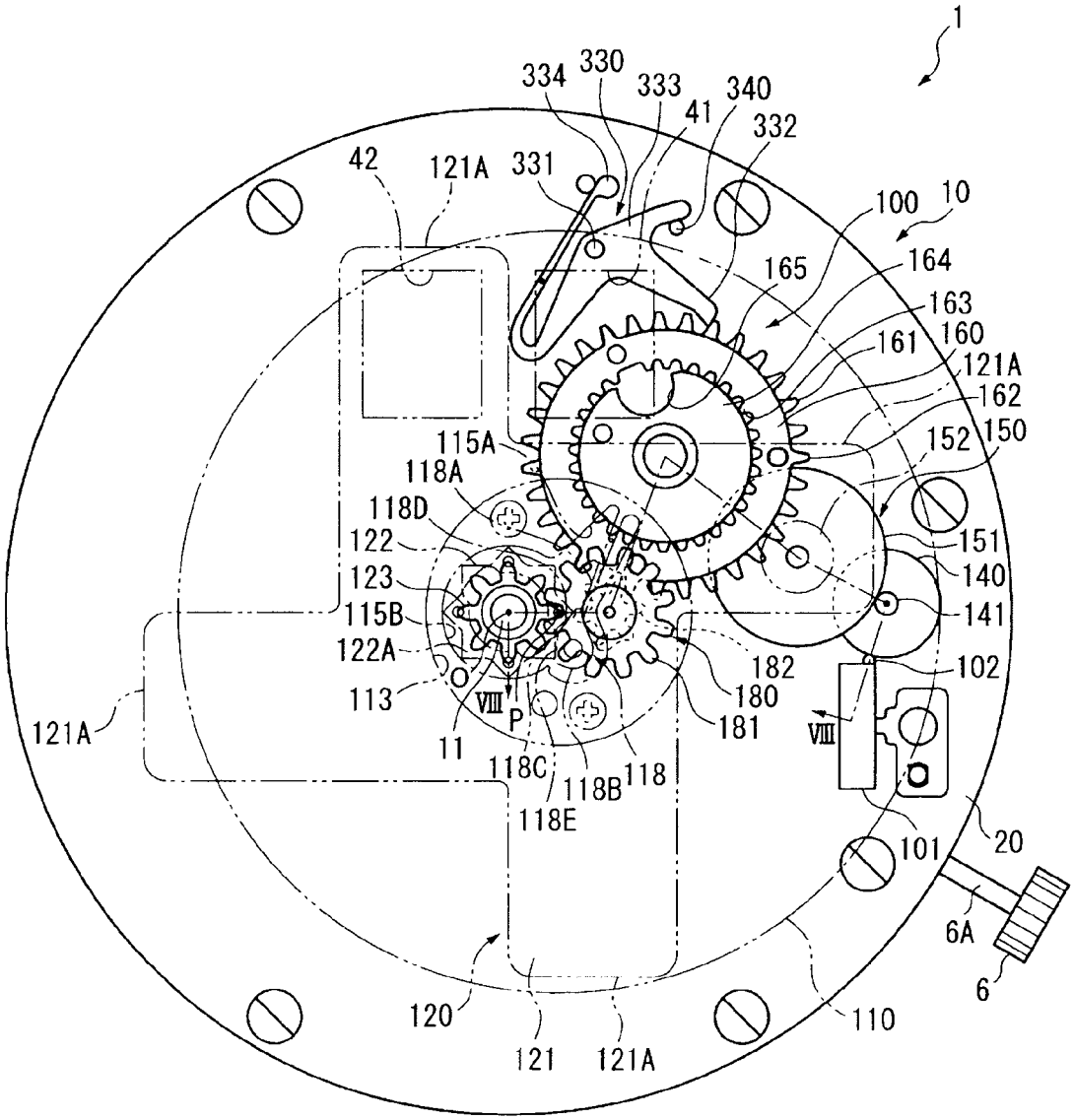
FIG. 6 is a plan view extracting the configuration for driving the tens intermediate wheel from FIG. 4.

FIG. 6 is a plan view showing the parts of the tens date indicator extracted from FIG. 4.

Figure 7:
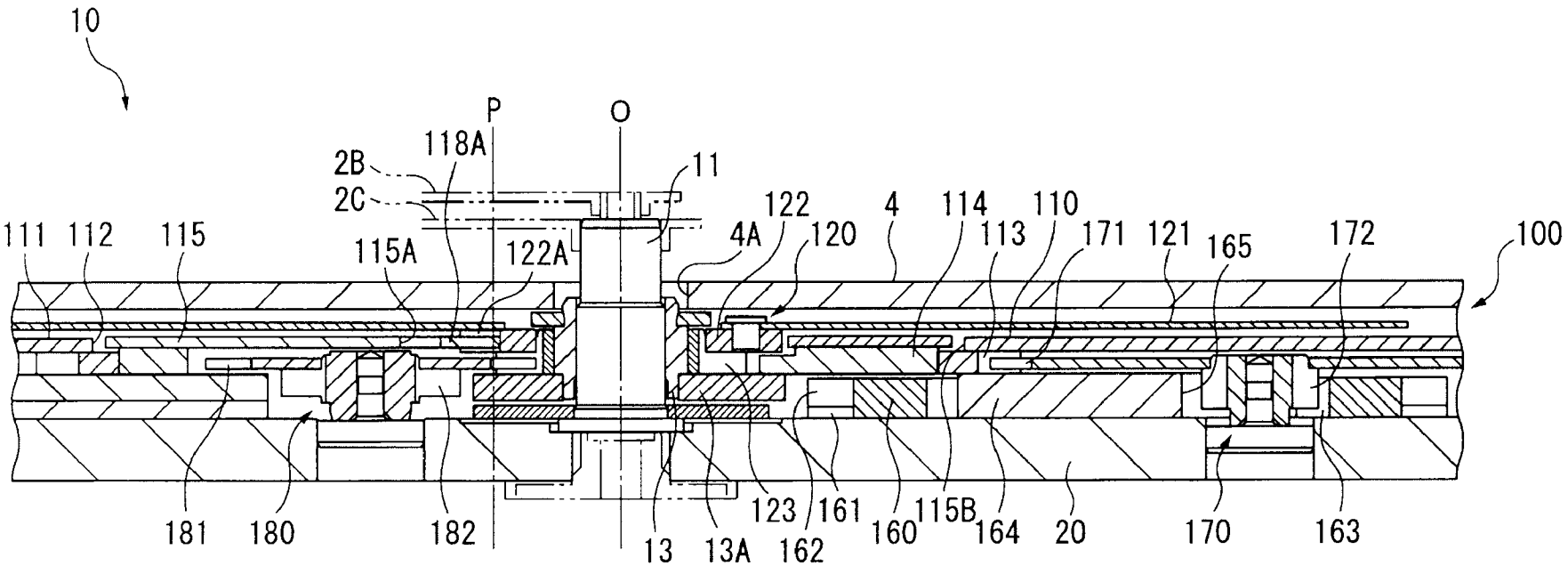
FIG. 7 is a section view of the configuration near the dial through line VII-VII in FIG. 4 and FIG. 5.

FIG. 7 is a section view showing the area near the dial through line VII-VII in FIG. 4 and FIG. 5.

Figure 8:
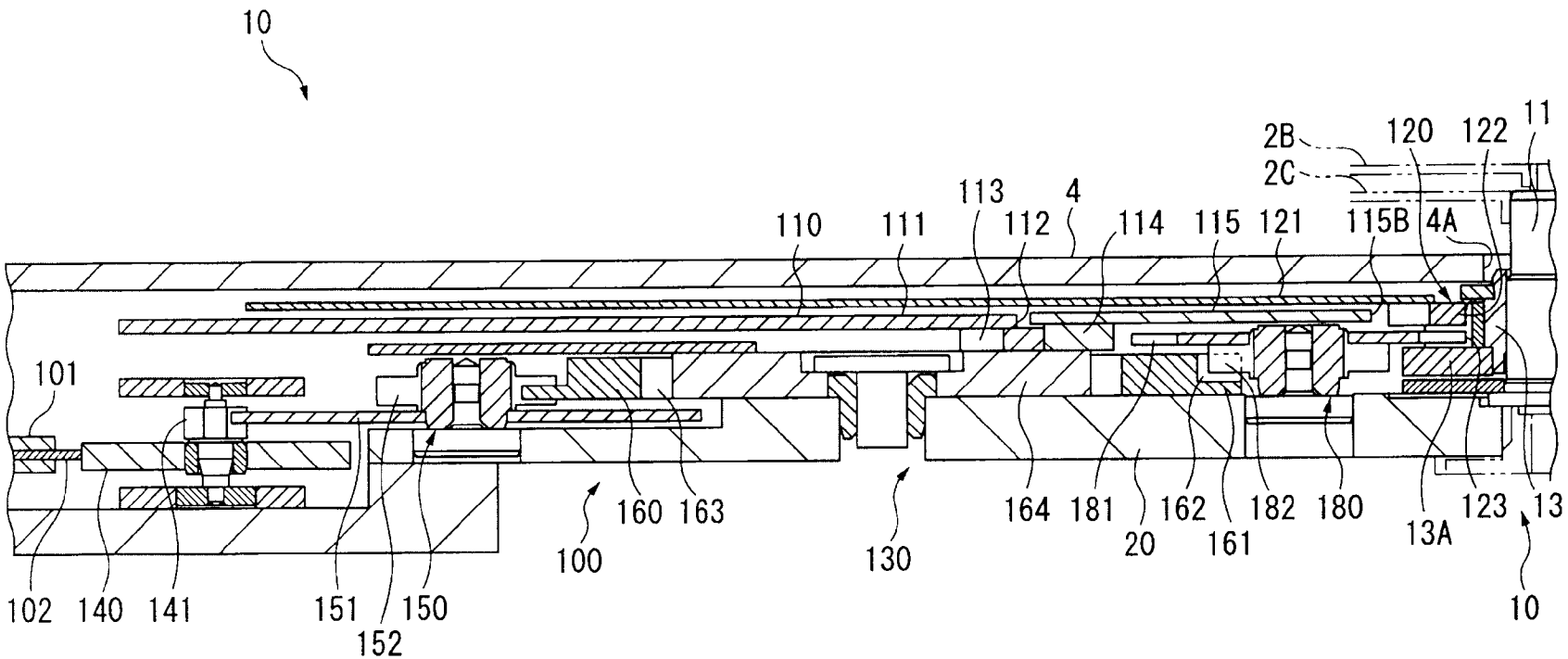
FIG. 8 is a section view of the configuration near the dial through line VIII-VIII in FIG. 4 and FIG. 6.

FIG. 8 is a section view showing the area near the dial through line VIII-VIII in FIG. 4 and FIG. 6.

Figure 9:
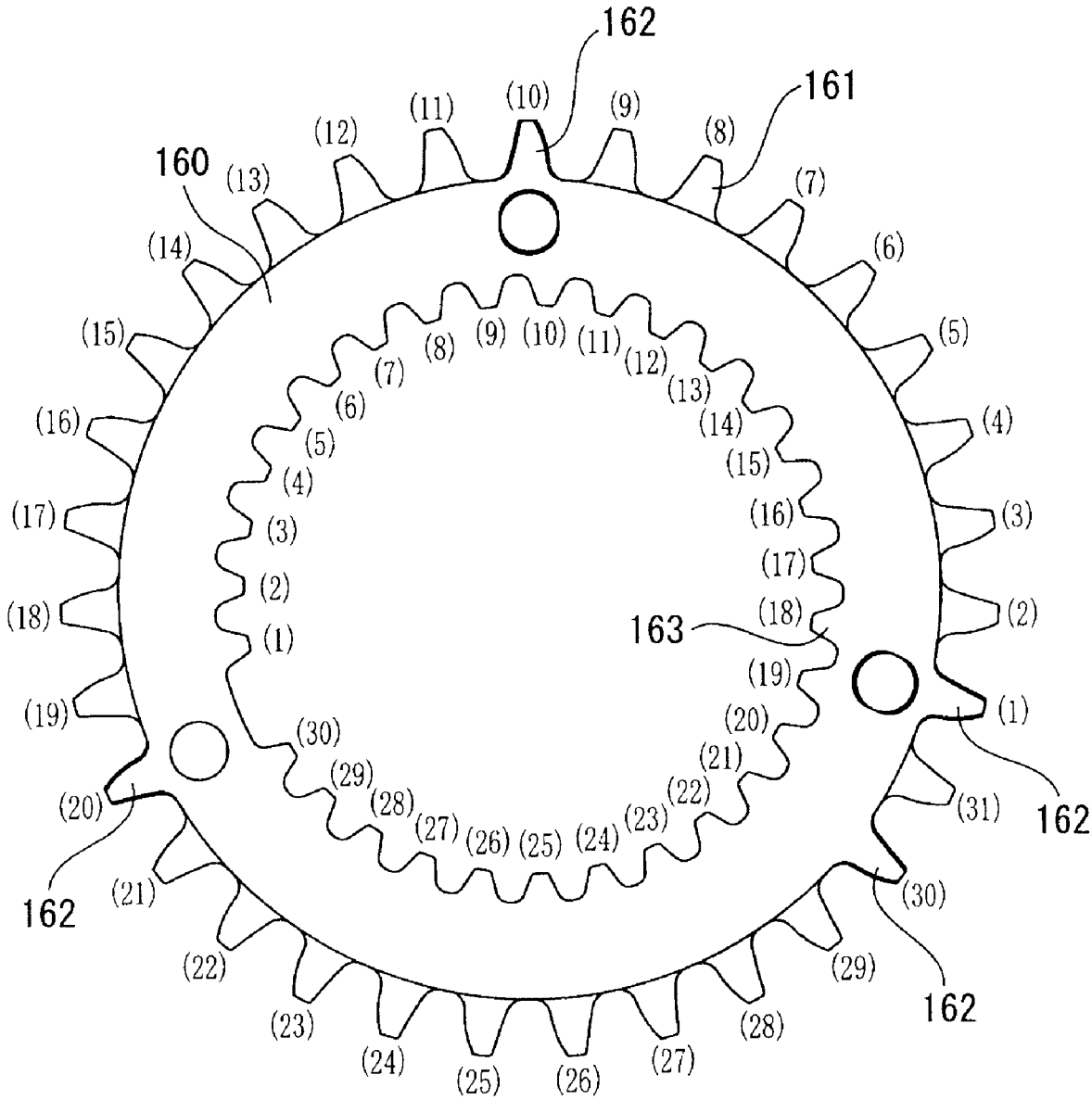
FIG. 9 is a plan view showing the configuration of the control wheel.

FIG. 9 is a plan view showing the configuration of the control wheel.

Figure 10:
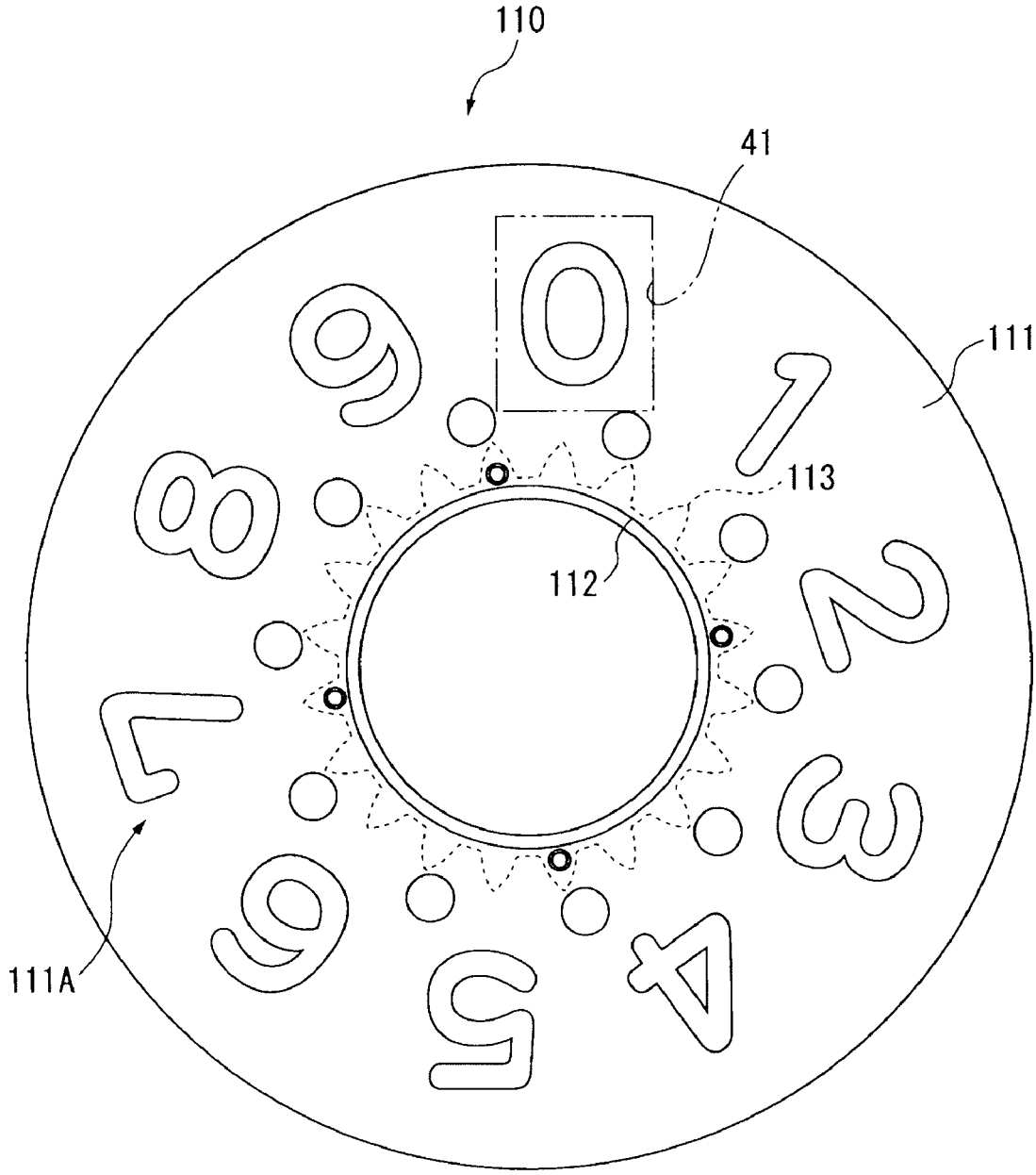
FIG. 10 is a plan view showing the configuration of the ones indicator wheel.

FIG. 10 is a plan view showing the configuration of the ones date indicator.

Figure 11:
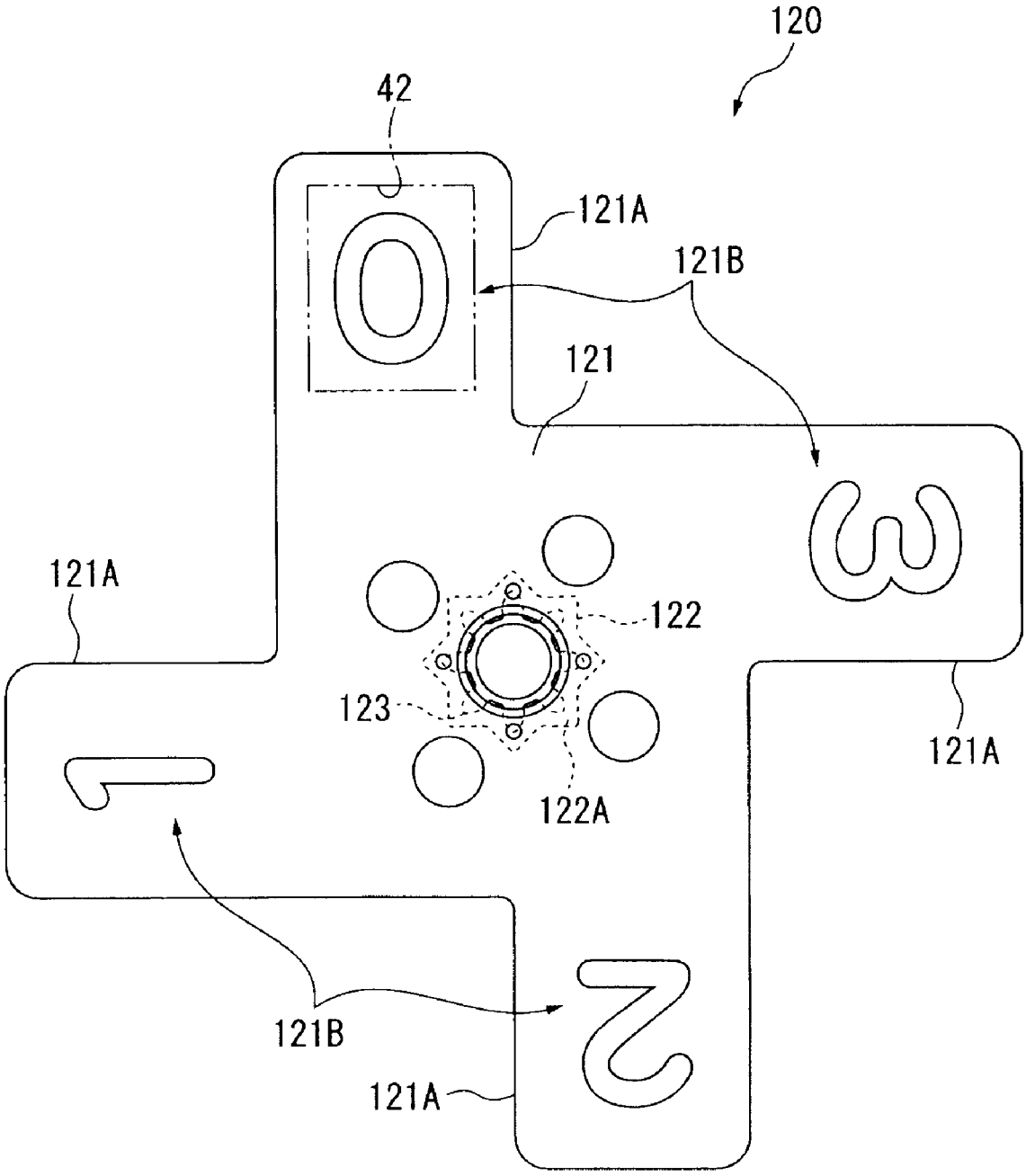
FIG. 11 is a plan view showing the configuration of the tens indicator wheel.

FIG. 11 is a plan view showing the configuration of the tens date indicator.

Referring to FIG. 4, the calendar mechanism 100 includes the ones indicator wheel 110 on which the ones date scale 111A (shown in FIG. 10) is disposed, the tens indicator wheel 120 on which the tens date scale 121B (see FIG. 11) is disposed, an actuator 101 as the date wheel drive power source that supplies drive power for driving the date indicators, and a drive power transfer wheel train 130 that relays the drive power produced by the actuator 101 to the date indicators.

The actuator 101 is a piezoelectric actuator that produces drive power from the electrical energy supplied from the battery 12 as controlled by the control circuit unit.

More specifically, the actuator 101 is affixed to the main plate 20 near the three o'clock position of the movement 10. The actuator 101 in this embodiment of the invention is substantially rectangular, and has a finger 102 that contacts the rotor 140 of the drive power transfer wheel train 130. When power is supplied and the actuator 101 vibrates, the finger 102 of the actuator 101 pushes the rotor 140 and causes the rotor 140 to turn.

As shown in FIG. 4 to FIG. 8, the drive power transfer wheel train 130 includes a rotor 140, a rotor transfer wheel 150, a control wheel 160, a ones intermediate wheel 170, and a tens intermediate wheel 180. These wheel components of the drive power transfer wheel train 130 are located between the twelve o'clock and the three o'clock positions of the movement 10, that is, between the battery 12 and the stem 6A that supports the crown 6. More specifically, the wheel components of the drive power transfer wheel train 130 are disposed to positions where they do not impinge on the locations where the battery 12 and stem 6A are disposed, and which are compatible with reducing the size and thickness of the timepiece. Note that the crown 6 and stem 6A are disposed substantially near the four o'clock position of the dial.

The rotor 140 is rotatably supported on the main plate 20 at a position on an extension of the long axis of the actuator 101. The outside of the rotor 140 is contacted by the finger 102 of the actuator 101, and rotates clockwise as seen in FIG. 4 to FIG. 6 when driven by the actuator 101.

The rotor 140 has a rotor pinion 141 that engages the outside of the rotor transfer wheel 150, and when the rotor 140 turns the drive power is transferred to the rotor transfer wheel 150.

The rotor transfer wheel 150 is rotatably supported on the main plate 20 near the three o'clock position of the movement 10. The rotor transfer wheel 150 includes a rotor transfer gear 151 and a rotor transfer pinion 152. The rotor transfer gear 151 has external teeth formed on the outside edge, meshes with the rotor pinion 141 as described above, and thus has drive power from the actuator 101 transferred thereto. The rotor transfer pinion 152 is rendered coaxially to in unison with the rotor transfer gear 151. The rotor transfer pinion 152 transfers the drive power transferred from the rotor 140 to the control wheel 160.

The control wheel 160 is ring shaped. As shown in FIG. 4 to FIG. 9, the control wheel 160 has rendered around the outside circumference thereof a drive power transfer wheel 161 formed on the back cover side in the thickness direction of the timepiece, and a tens control wheel 162 formed on the dial 4 side in the thickness direction of the timepiece. The control wheel 160 also has formed around the inside circumference thereof a ones control wheel 163.

The drive power transfer wheel 161 has 31 external teeth rendered at equal intervals around the outside circumference of the control wheel 160. This drive power transfer wheel 161 meshes with the rotor transfer pinion 152 of the rotor transfer wheel 150. As a result, when the drive power transfer wheel 161 is turned the distance of one tooth by the rotor transfer wheel 150, the control wheel 160 rotates 360/31 degrees.

The tens control wheel 162 has four external teeth disposed around the outside circumference of the control wheel 160, and these four teeth are formed at specific positions causing the tens indicator wheel 120 to rotate when the calendar unit 40 displays the dates 01, 10, 20, and 30.

More specifically, as shown in FIG. 9, if the 31 external teeth of the drive power transfer wheel 161 are numbered 1 to 31 counterclockwise, the four external teeth of the tens control wheel 162 are formed at positions overlapping external teeth numbers 1, 10, 20, and 30 of the drive power transfer wheel 161. More specifically, the four external teeth of the tens control wheel 162 are disposed counterclockwise at intervals of (360/31)*9 degrees, (360/31)*10 degrees, (360/31)*10 degrees, and (360/31)*2 degrees.

The tens control wheel 162 is formed so that it can engage the tens intermediate wheel 180.

Therefore, when the drive power of the actuator 101 causes the control wheel 160 to turn and the external teeth of the drive power transfer wheel 161 turn the distance of 9 teeth, 10 teeth, 10 teeth, and 2 teeth, the tens control wheel 162 engages the tens intermediate wheel 180 and causes the tens intermediate wheel 180 to turn.

The ones control wheel 163 has 30 internal teeth disposed around the inside circumference of the control wheel. The teeth of the ones control wheel 163 are disposed at a 360/31 degree interval. More specifically, as shown in FIG. 9, if the internal teeth of the ones control wheel 163 are number 1 to 30, there is a gap of (360/31)*2 degrees between tooth 1 and tooth 30, that is, there is a gap of one tooth. This gap corresponds to dates where the "1" of the ones digit in the 31st and the 1st are consecutive, and enables setting the ones digit display to a 1 even though the control wheel 160 has rotated the distance of one day.

This ones control wheel 163 meshes with the ones intermediate wheel 170, and transfers the torque of the control wheel 160 to the ones intermediate wheel 170.

As shown in FIG. 5 to FIG. 8, a control wheel guide plate 164 is disposed on the inside circumference side of the control wheel 160. This control wheel guide plate 164 is substantially disc shaped formed with the outside circumference edge following an imaginary circle (inside circumference edge of the control wheel 160) joining the distal ends of the internal teeth of the ones control wheel 163, and has a notch 165 in which the pinion (ones intermediate pinion 172) of the ones intermediate wheel 170 is disposed. The control wheel guide plate 164 is fastened by a screw, for example, to the main plate 20. As a result, the control wheel guide plate 164 thus rotatably supports the control wheel 160 at a specific position in the movement 10.

As shown in FIG. 4, FIG. 5, and FIG. 7, the ones intermediate wheel 170 is rotatably supported on the main plate 20 inside the notch 165 of the control wheel guide plate 164 on the inside circumference side of the control wheel 160. The ones intermediate wheel 170 has a ones intermediate gear 171 and a ones intermediate pinion 172 rendered coaxially in unison with the ones intermediate gear 171. The ones intermediate pinion 172 engages the ones control wheel 163 of the control wheel 160. As a result, when the ones intermediate pinion 172 is turned by the drive power from the control wheel 160, the ones intermediate gear 171 is driven rotationally in conjunction therewith. The ones intermediate gear 171 meshes with the ones indicator pinion 113 of the ones indicator wheel 110, and transfers drive power from the control wheel 160 to the ones indicator wheel 110.

The ones intermediate pinion 172 is a gear with six external teeth disposed evenly around the outside circumference. When the ones intermediate pinion 172 is turned one tooth by the ones control wheel 163 of the control wheel 160, it rotates 60 degrees.

The ones intermediate gear 171 is a gear with twelve teeth disposed evenly around the outside circumference, and causes the ones indicator pinion 113 to turn two teeth when the ones indicator pinion 113 is turned 60 degrees by the control wheel 160.

As shown in FIG. 4, FIG. 5, FIG. 7, and FIG. 10, the ones indicator wheel 110 has a substantially disk shaped ones indicator plate 111 with a hole of a specific diameter (center hole 112) rendered in the center, and a ones indicator pinion 113 affixed around the center hole 112 of the ones indicator plate 111. The ones indicator plate 111 and ones indicator pinion 113 are rendered separately in this embodiment of the invention, but may alternatively be rendered in unison as a plastic molding.

The ones indicator plate 111 has a ones date scale 111A printed with the ten ones digits of the date on the side facing the dial 4. More specifically, the ones date scale 111A has the ten ones digits 0 to 9 printed evenly sequentially in the clockwise direction on the side of the hand shaft 11 facing the dial 4. One of these ten ones digits is located opposite the ones digit window 41 of the dial 4. When the ones indicator plate 111 turns one day (36 degrees) counterclockwise, for example, the ones digit adjacent in the clockwise direction moves to the position opposite the ones digit window 41, and the displayed ones digit of the date changes.

The ones indicator pinion 113 is ring shaped and is fastened to the ones indicator plate 111 by screws, for example. Twenty external teeth are disposed uniformly at an interval of 18 degrees around the outside circumference of the ones indicator pinion 113. When the control wheel 160 causes the ones intermediate wheel 170 to turn one day (60 degrees), the ones intermediate wheel 170 causes the ones indicator pinion 113 to turn two teeth, and the ones indicator wheel 110 rotates 36 degrees.

The center of rotation of this ones indicator wheel 110 is set to a position (eccentric point P) separated a specific distance toward the three o'clock position from the center point O of the movement 10 where the hand shaft 11 is disposed.

A ones indicator guide plate 114 with a curved face with a diameter substantially equal to the inside diameter of the center hole 112 is fixed to the main plate 20 inside the center hole 112 of the ones indicator wheel 110. A substantially U-shaped tens positioning notch 114A accommodating the tens indicator pinion 123 and tens intermediate wheel 180 is formed from the three o'clock end part of the ones indicator guide plate 114. The ones indicator guide plate 114 is thus substantially C-shaped in plan view, and the outside circumference edge thereof guides the ones indicator wheel 110.

A ones indicator clamp 115 is disposed inside the center hole 112. This ones indicator clamp 115 has a jumper notch 115A where the tens jumper 118 is disposed, and a tens indicator pinion insertion part 115B in which the tens indicator pinion 123 can be inserted. The ones indicator guide plate 114 and ones indicator clamp 115 are fastened together to the main plate 20 with a screw. The ones indicator guide plate 114 thus rotatably supports the ones indicator wheel 110 with the tens indicator pinion 123 and tens intermediate wheel 180 on the inside circumference side of the ones indicator pinion 113.

A jumper plate 116 is disposed to the main plate 20 at the same height as the ones indicator pinion 113 in the thickness direction of the timepiece 1. This jumper plate 116 is formed from the twelve o'clock position of the movement 10 around the nine o'clock, six o'clock, and three o'clock positions surrounding the ones indicator pinion 113. As shown in FIG. 5, a ones jumper 117 is disposed to the jumper plate 116 extending from the twelve o'clock end towards the ones indicator pinion 113. This ones jumper 117 engages the ones indicator pinion 113 and positions the ones indicator pinion 113 and ones indicator plate 111 in the rotational direction.

The ones jumper 117 includes a ones jumper neck 117A and a ones jumper head 117B disposed to the distal end of the ones jumper neck 117A.

The ones jumper neck 117A extends from the jumper plate 116 toward the ones indicator pinion 113, and urges the ones jumper head 117B toward the ones indicator pinion 113 by elastic force.

The ones jumper head 117B has a ones jumper detent 117C that protrudes toward the ones indicator pinion 113 at substantially the middle of the side facing the external teeth of the ones indicator pinion 113, and ones jumper inclines 117D and 117E that slope to both sides from the ones jumper detent 117C away from the ones indicator pinion 113 toward the opposite ends of the ones jumper head 117B.

As a result, when the ones indicator pinion 113 turns, a tooth of the ones indicator pinion 113 pushes against the ones jumper incline 117D of the ones jumper head 117B, and the ones jumper 117 is pushed toward the outside circumference of the timepiece 1. When the tooth of the ones indicator pinion 113 passes the ones jumper detent 117C, the urging force of the ones jumper neck 117A pushes the ones jumper head 117B to the ones indicator pinion 113, and the ones jumper incline 117E pushes the ones indicator pinion 113 counterclockwise. The timing when the ones indicator pinion 113 passes the ones jumper detent 117C is adjusted so that the position matches the timing at which the minute hand 2B and hour hand 2C are moved by the hand driving mechanism to the positions pointing to 0:00.

As shown in FIG. 4, FIG. 6, and FIG. 8, the tens intermediate wheel 180 is rotatably supported on the main plate 20 on the inside circumference side of the ones indicator pinion 113. The tens intermediate wheel 180 includes a tens intermediate gear 181 and a tens intermediate pinion 182 disposed coaxially in unison with the tens intermediate gear 181. The tens intermediate pinion 182 is disposed so that it can engage the tens control wheel 162 of the control wheel 160, and when the tens intermediate pinion 182 is turned by the tens control wheel 162 the tens intermediate wheel 180 also turns. The tens intermediate gear 181 is disposed at the same elevation within the thickness of the ones indicator pinion 113 in the thickness direction of the timepiece. This tens intermediate gear 181 engages the tens indicator pinion 123 of the tens indicator wheel 120, and transfers drive power from the control wheel 160 to the tens indicator wheel 120.

The tens intermediate pinion 182 is a gear with six external teeth disposed evenly around the outside circumference, and rotates 60 degrees when turned one tooth by the tens control wheel 162 of the control wheel 160. The tens intermediate gear 181 is a gear with twelve external teeth disposed uniformly around the outside circumference, and causes the tens indicator pinion 123 to turn two teeth when the tens intermediate wheel 180 is turned 60 degrees by the control wheel 160.

The tens indicator wheel 120 is disposed rotatably concentrically to the hand shaft 11. More specifically, as shown in FIG. 8, a tens indicator guide barrel 13 in which the hand shaft 11 is inserted is disposed concentrically to the hand shaft 11, and the tens indicator wheel 120 is rotatably supported on a flange 13A that protrudes radially from the tens indicator guide barrel 13.

As shown in FIG. 6, FIG. 8, and FIG. 11, the tens indicator wheel 120 has a tens indicator plate 121, a jumper engaging part 122, and the tens indicator pinion 123.

The tens indicator plate 121 is shaped substantially like a cross with four tens indicator tabs 121A projecting radially at 90 degree intervals from the center of rotation. The tens date scale 121B is printed with one of the tens digits of the date disposed on each of the tens indicator tabs 121A on the side facing the dial 4. More specifically, the tens digits 0, 1, 2, 3 are printed sequentially in the counterclockwise direction on the tens indicator tabs 121A on the side facing the dial. One of these four tens digits is disposed to a position opposite the tens digit window 42 of the dial 4, and when the tens indicator plate 121 rotates clockwise 90 degrees, for example, the tens digit adjacent in the counterclockwise direction moves to the position opposite the tens digit window 42. The path of the distal ends of the four tens indicator tabs 121A of the tens indicator plate 121 is contained substantially within the inside diameter of the outside circumference edge of the ones indicator plate 111 of the ones indicator wheel 110.

The tens indicator pinion 123 is affixed by screws, for example, to the back side of the tens indicator plate 121 with the jumper engaging part 122 therebetween. Note that the tens indicator plate 121, jumper engaging part 122, and tens indicator pinion 123, or the jumper engaging part 122 and tens indicator pinion 123, may be made from plastic and rendered in unison.

The tens indicator pinion 123 is disposed on the inside circumference side of the ones indicator pinion 113 at substantially the same height as the tens intermediate gear 181 in the timepiece thickness direction, that is, within the thickness of the ones indicator pinion 113. The tens indicator pinion 123 meshes with the tens intermediate gear 181, and when drive power is transferred thereto from the tens intermediate gear 181 causes the tens indicator wheel 120 to turn.

Eight external teeth are disposed uniformly at a 45 degree interval around the outside circumference of the tens indicator pinion 123. As described above, when the tens intermediate wheel 180 is driven one tooth by the tens control wheel 162 of the control wheel 160 and turns 60 degrees, it causes the tens indicator pinion 123 to turn two teeth. The tens indicator pinion 123 therefore turns 90 degrees, and the tens indicator wheel 120 also turns 90 degrees.

The jumper engaging part 122 is a flat member disposed between the tens indicator plate 121 and tens indicator pinion 123, and is a star-shaped octagon with tooth-engaging parts 122A protruding in the same directions as the eight external teeth of the tens indicator pinion 123.

The tens jumper 118 disposed to the ones indicator clamp 115 located in the center hole 112 of the ones indicator wheel 110 engages the jumper engaging part 122, positions the jumper engaging part 122 in the rotational direction, and thus positions the rotational direction of the tens indicator plate 121.

More specifically, as shown in FIG. 5 to FIG. 8, the ones indicator clamp 115 is formed with substantially the same diameter as the center hole 112, and as described above is disposed affixed to the ones indicator guide plate 114 and the main plate 20 on the dial 4 side of the ones indicator guide plate 114. This ones indicator clamp 115 is disposed at substantially the same height as the jumper engaging part 122 in the timepiece thickness direction, and the jumper engaging part 122 is inserted to the jumper notch 115A.

A tens jumper 118 that projects from the jumper notch 115A toward the jumper engaging part 122 is disposed to the ones indicator clamp 115. Similarly to the ones jumper 117, the tens jumper 118 has a tens jumper neck 118A and a tens jumper head 118B that is disposed on the distal end of the tens jumper neck 118A.

The tens jumper neck 118A extends from one part of the jumper notch 115A toward the jumper engaging part 122, and urges the tens jumper head 118B by elastic force toward the jumper engaging part 122.

The tens jumper head 118B has a tens jumper detent 118C that protrudes toward the tooth-engaging parts 122A side from substantially the middle of the side facing the jumper engaging part 122 of the tens indicator wheel 120, and tens jumper inclines 118D and 118E that slope to both sides from the tens jumper detent 118C away from the tooth-engaging parts 122A toward the opposite ends of the tens jumper head 118B.

As a result, when the tens indicator wheel 120 turns, the tooth-engaging part 122A of the jumper engaging part 122 pushes the tens jumper incline 118D of the tens jumper head 118B in and pushes the tens jumper 118 radially out. When the tooth-engaging part 122A passes the tens jumper detent 118C, the tens jumper head 118B is pushed to the jumper engaging part 122 side by the urging force of the tens jumper neck 118A, and the tens jumper incline 118E pushes the tooth-engaging part 122A clockwise. The timing when the tooth-engaging part 122A passes over the tens jumper detent 118C is adjusted to the position matching the timing when the minute hand 2B and hour hand 2C are moved by the hand driving mechanism to the positions pointing to 0:00.

Day Hand Driving Mechanism

Figure 12:
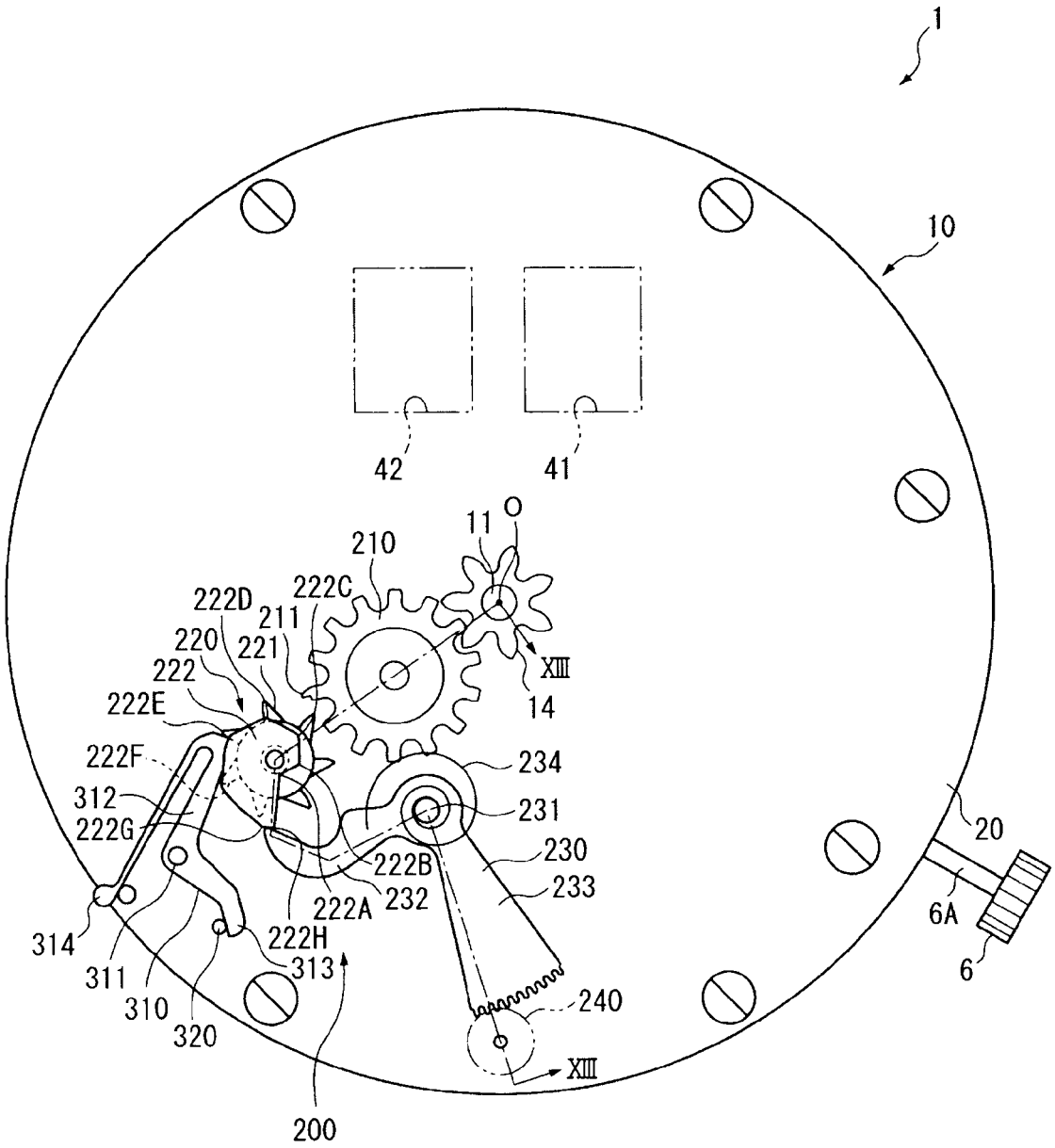
FIG. 12 is a plan view extracting the configuration of the day hand driving mechanism from FIG. 4.

FIG. 12 is a plan view extracting from FIG. 4 the components of the day hand driving mechanism rendering a fan-shaped information display unit.

Figure 13:
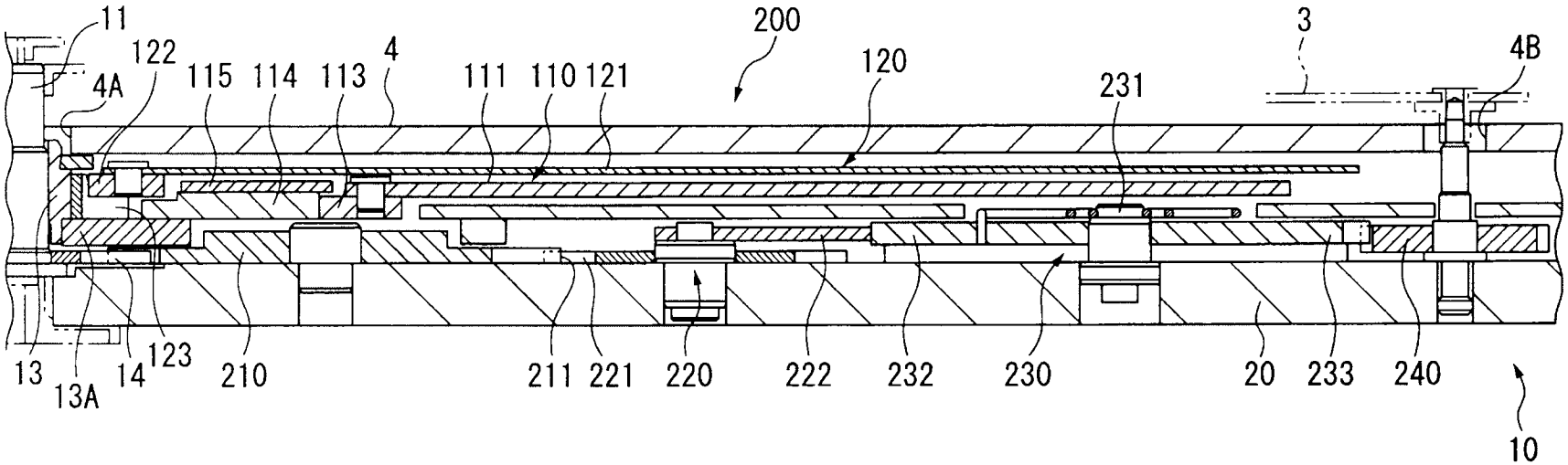
FIG. 13 is a section view of the configuration near the dial through line XIII-XIII in FIG. 4 and FIG. 12.

FIG. 13 is a section view near the dial through line XIII-XIII in FIG. 4 and FIG. 12.

As shown in FIG. 4 and FIG. 12, the day hand drive mechanism 200 is rendered between the nine o'clock and six o'clock positions of the movement 10. More specifically, when seen in plan view, the day hand drive mechanism 200 is disposed between the battery 12 and the stem 6A on the opposite side as the calendar mechanism 100. The day hand drive mechanism 200 is thus configured to avoid members such as the battery 12 and stem 6A that are thick in the timepiece thickness direction, and is disposed at a position not overlapping the wheels of the calendar mechanism 100, thereby suppressing increasing the thickness of the timepiece 1. The day hand drive mechanism 200 has a 24-hour wheel 210, a day star wheel 220, a day lever 230, and a day hand wheel 240.

The 24-hour wheel 210 is disposed near the hand shaft 11, and meshes with the hour wheel 14 disposed in unison with the hour hand shaft supporting the hour hand 2C. The hour wheel 14 has, for example, seven external teeth disposed around the outside. As shown in FIG. 4 and FIG. 12, the 24-hour wheel 210 has fourteen external teeth disposed evenly around the outside. The 24-hour wheel 210 therefore turns once for every two revolutions of the hour wheel, that is, once every 24 hours.

A day drive tooth 211 that protrudes radially to the outside is disposed to one of the fourteen external teeth of the 24-hour wheel. The day drive tooth 211 engages the day star wheel 220 once in 24 hours, and causes the day star wheel 220 to turn clockwise. The timing at which the day drive tooth 211 engages the day star wheel 220 and turns the day star wheel 220 is adjusted to match the timing when the minute hand 2B and hour hand 2C are moved by the hand driving mechanism to the positions pointing to 0:00.

The day star wheel 220 has a day claw wheel 221, and a day control plate 222 disposed in unison with and coaxially to the day claw wheel 221. The day claw wheel 221 has seven external teeth around the outside disposed uniformly at a 360/7 degree interval. The day claw wheel 221 is shaped like a ratchet wheel. More specifically, each tooth of the day claw wheel 221 is substantially triangular with a first side that extends in the radial direction, and a second side that slopes at a specific angle in the clockwise direction from the distal end of the first side. The day claw wheel 221 rotates 360/7 degrees clockwise when the day drive tooth 211 of the 24-hour wheel engages and pushes the first side of an external tooth.

The day control plate 222 is basically octagonal with eight corner parts (first corner part 222A to eighth corner part 222H) at different distances from the axis of rotation. The corner parts 222A to 222H are arranged sequentially counterclockwise starting from the shortest distance from the axis of rotation. The corner part at the shortest distance from the axis of rotation is first corner part 222A, and the first to eighth corner parts 222A to 222H are arranged sequentially counterclockwise. The distance of the first to seventh corner parts 222A to 222G from the axis of rotation each increases a specific distance (called the "day setting distance" below) starting from the shortest distance of the first corner part 222A. More specifically, the difference in the distance from the axis of rotation is substantially the same between the first corner part 222A and second corner part 222B, between the second corner part 222B and third corner part 222C, between the third corner part 222C and fourth corner part 222D, between the fourth corner part 222D and fifth corner part 222E, between the fifth corner part 222E and sixth corner part 222F, and between the sixth corner part 222F and seventh corner part 222G. In addition, though not shown in the figures, the sides of the first corner part 222A to the seventh corner part 222G have a circular arc part connected to the first corner part 222A to seventh corner part 222G, and a straight part that is substantially straight and connects the other end part of the circular arc part with the adjacent corner part. The diameter of the circular arc part from the axis of rotation is the same as the distance from the first corner part 222A to seventh corner part 222G to which the circular arc part is connected to the axis of rotation. The distance of the eighth corner part 222H from the axis of rotation is equal to the distance from the axis of rotation to the seventh corner part 222G, and the seventh corner part 222G and eighth corner part 222H are connected only by a circular arc part with a diameter equal to this distance. The circular arc parts between the first corner part 222A to eighth corner part 222H are disposed on extension lines of the external teeth of the day claw wheel 221.

The day lever 230 is a flat member disposed pivotably on the main plate 20 between the day star wheel 220 and day hand wheel 240. The day lever 230 has a hook-shaped angle adjusting part 232 that extends from the lever pivot pin 231 toward the day star wheel 220, and a day hand control part 233 that extends toward the day hand wheel 240. The day lever 230 is urged clockwise by a hairspring 234.

The distal end part of the angle adjusting part 232 contacts the outside of the day control plate 222 of the day star wheel 220. Because the day lever 230 is urged counterclockwise by the hairspring 234, the position contacted by the distal end of the angle adjusting part 232 changes according to the rotational position of the day star wheel 220, and the angle of the day lever 230 therefore changes.

For example, when the distal end of the angle adjusting part 232 is in contact with the circular arc part of the first corner part 222A (the initial position), the day lever 230 is rotated clockwise to the position at the end of rotation. When the day star wheel 220 is driven by the 24-hour wheel 210 and turns one tooth clockwise, the distal end part of the angle adjusting part 232 of the day lever 230 passes the second corner part 222B and stops in contact with the circular arc part connected to the second corner part 222B. As a result, the angle adjusting part 232 is pushed the day setting distance to the outside diameter side of the day star wheel 220, and rotates counterclockwise a specific distance corresponding to the day setting distance. Thereafter, the day lever 230 rotates sequentially counterclockwise in conjunction with rotation of the day star wheel 220 until the distal end of the angle adjusting part 232 contacts the circular arc part between the seventh corner part 222G and the eighth corner part 222H. When the day star wheel 220 then turns the distance of one tooth from where the distal end of the angle adjusting part 232 contacts the circular arc part between the seventh corner part 222G and eighth corner part 222H, the distal end of the angle adjusting part 232 passes the eighth corner part 222H and contacts the circular arc part connected to the first corner part 222A again. This causes the day lever 230 to rotate clockwise to the position at the end of rotation and return to the initial position.

The day hand control part 233 is basically fan shaped, and teeth that mesh with the day hand wheel are formed along the fan curve. When the day lever 230 is turned by the angle adjusting part 232 as described above, the day lever 230 causes the day hand wheel 240 to turn a specific angle.

The day hand 3 such as shown in FIG. 3 is attached to the pivot pin of the day hand wheel 240. The day hand 3 is disposed with the pivot axis at the six o'clock side and the distal end pointing towards the hand shaft 11 side. The day hand wheel 240 has a gear that can mesh with the teeth of the day hand control part 233, and as described above rotates in conjunction with rotation of the day lever 230. As a result, the day hand 3 can be caused to pivot within a specific angle.

Calendar Drive Control Mechanism

A calendar drive control mechanism that drives the calendar mechanism 100 described above by means of switching control is described next.

As shown in FIG. 4, FIG. 6, and FIG. 12, the calendar drive control mechanism has a 24:00 detection switch lever 310, a 24:00 detection pin 320, a date changing detection switch lever 330, a date changing detection pin 340, and the control circuit unit described above.

As shown in FIG. 4 and FIG. 12, the 24:00 detection switch lever 310 and 24:00 detection pin 320 are disposed proximally to the day star wheel 220. The 24:00 detection switch lever 310 and 24:00 detection pin 320 render a 24:00 detection switch.

More specifically, the 24:00 detection switch lever 310 is disposed on the outside diameter side of the day star wheel 220 in the movement 10. The 24:00 detection switch lever 310 is a flat elongated member and has a switch lever center 311 substantially in the middle where it is rotatably attached to the main plate 20. The 24:00 detection switch lever 310 has a rotation detection part 312 that extends from the switch lever center 311 to the day star wheel 220 side, and a pin contacting part 313 that can contact the 24:00 detection pin 320 disposed proximally to the outside edge of the movement 10.

The rotation detection part 312 has a spring part 314 that folds back in a U-shape from the distal end side. Movement of the spring part 314 is limited by a pin disposed to the main plate 20, and urges the rotation detection part 312 to the day star wheel 220 side. The distal end part of the rotation detection part 312 normally engages an external tooth interval of the day claw wheel 221 of the day star wheel 220. When the day claw wheel 221 turns, the rotation detection part 312 is pushed out by a tooth of the day claw wheel 221 and turns counterclockwise. When the day claw wheel 221 turns again and the tooth of the day claw wheel 221 rotates passed the distal end part of the rotation detection part 312, the rotation detection part 312 is re-engaged with a tooth interval of the day claw wheel 221 by the urging force of the spring part 314.

The 24:00 detection switch lever 310 and 24:00 detection pin 320 are made of metal or other electrically conductive material. The switch lever center 311 and 24:00 detection pin 320 are each electrically connected to the control circuit unit. When a specific voltage is applied by the control circuit unit between the 24:00 detection switch lever 310 and 24:00 detection pin 320, and the pin contacting part 313 and 24:00 detection pin 320 are in contact, the pin contacting part 313 and 24:00 detection pin 320 are electrically conductive (continuity exists). When rotation of the day claw wheel 221 pushes the rotation detection part 312 out and the 24:00 detection switch lever 310 rotates counterclockwise, the pin contacting part 313 separates from the 24:00 detection pin 320 and continuity between the pin contacting part 313 and 24:00 detection pin 320 is interrupted (discontinuity exists). When the rotation detection part 312 then engages a tooth interval of the day claw wheel 221 and the 24:00 detection switch lever 310 turns clockwise, the pin contacting part 313 and the 24:00 detection pin 320 make contact again and continuity is restored.

As shown in FIG. 4, FIG. 5, and FIG. 6, the date changing detection switch lever 330 and date changing detection pin 340 are disposed proximally to the control wheel 160. The date changing detection switch lever 330 and date changing detection pin 340 render a date changing detection switch.

More specifically, the date changing detection switch lever 330 is disposed on the outside circumference side of the control wheel 160 in the movement 10. The date changing detection switch lever 330 has a flat elongated shape with a switch lever center 331 substantially in the middle where it is rotatably attached to the main plate 20. The date changing detection switch lever 330 has a control detection part 332 that extends from the switch lever center 331 to the control wheel 160 side, a pin contacting part 333 that can contact the date changing detection pin 340 disposed proximally to the outside edge of the movement 10, and a spring part 334 that extends substantially in a U-shape from the switch lever center 331 toward the outside diameter side of the timepiece 1.

The distal end part of the control detection part 332 normally engages the drive power transfer wheel 161 of the control wheel 160. When the control wheel 160 turns, the control detection part 332 is pushed out by a tooth of the drive power transfer wheel 161 and pivots in the counterclockwise direction.

Movement of the distal end of the spring part 334 is limited by a pin disposed to the main plate 20, and when the date changing detection switch lever 330 is pushed out in the counterclockwise direction, the spring part 334 pushes back in the clockwise direction and urges the control detection part 332 to the control wheel 160 side.

The date changing detection switch lever 330 and date changing detection pin 340 are made of metal or other electrically conductive material. The switch lever center 331 and date changing detection pin 340 are each electrically connected to the control circuit unit. When a specific voltage is applied by the control circuit unit between the date changing detection switch lever 330 and date changing detection pin 340, and the pin contacting part 333 and date changing detection pin 340 are in contact, the pin contacting part 333 and date changing detection pin 340 are electrically conductive (continuity exists). When the control detection part 332 is pushed out by rotation of the control wheel 160 and the date changing detection switch lever 330 rotates in the counterclockwise direction, the pin contacting part 333 separates from the date changing detection pin 340, and continuity between the pin contacting part 333 and date changing detection pin 340 is interrupted (discontinuity exists). When the control detection part 332 is then again engaged by the control wheel 160 and the date changing detection switch lever 330 turns clockwise, the pin contacting part 333 and date changing detection pin 340 make contact again and continuity is restored.

The calendar drive control mechanism configured as described above drives the calendar mechanism 100 as described below.

The control circuit unit first detects the state of the 24:00 detection switch (the contact state of the 24:00 switch lever and the 24:00 detection pin). More specifically, when the contact state of the 24:00 detection switch lever 310 and 24:00 detection pin 320 changes from a discontinuity state to a continuity state, a 24:00 detection signal is input from the 24:00 detection switch to the control circuit unit. When the 24:00 detection signal is input from the 24:00 detection pin 320, the control circuit unit applies a specific drive voltage to the actuator 101 and drives the calendar mechanism 100.

When the control wheel 160 turns due to the drive power from the actuator 101, the contact state of the date changing detection switch lever 330 and date changing detection pin 340 changes from a continuity state to a discontinuity state, and an on voltage is input to the control circuit unit. While this on voltage is applied the control circuit unit continuously applies voltage to the actuator 101. When the control wheel 160 turns 360/31 degrees (one day), the date changing detection switch lever engages the control wheel 160 again, the contact state of the date changing detection switch lever 330 and date changing detection pin 340 changes from discontinuity to continuity, and an off voltage is input to the control circuit unit. When the control circuit unit detects input of the off voltage from the date changing detection switch, the control circuit unit stops applying voltage to the actuator 101.

Timepiece Operation

Operation of the calendar mechanism 100 and the day hand drive mechanism 200 of the timepiece 1 described above is described next. Note that the date "09" is displayed in the following description of timepiece operation by way of example.

When drive power is transferred from the hand drive mechanism of the timepiece 1 to the hand shaft 11 that supports hour hand 2C, drive power is passed from the hour wheel 14 to the 24-hour wheel 210, and the 24-hour wheel 210 rotates one day (24 hours). At the timing when the minute and hour hands 2B, 2C of the timepiece 1 point to 0:00, the day drive tooth 211 of the 24-hour wheel 210 causes the day claw wheel 221 of the day star wheel 220 to turn one tooth (360/7 degrees).

When the day claw wheel 221 turns the day control plate 222 also turns 360/7 degrees. As a result, the point of contact between the outside edge of the day control plate 222 and the distal end part of the angle adjusting part 232 of the day lever 230 changes, and the day lever 230 turns.

For example, when the angle adjusting part 232 is in contact with the circular arc part connected to the first corner part 222A, the day lever 230 rotates clockwise to the rotation limit. As a result, the day hand wheel 240 meshed with the day hand control part 233 turns counterclockwise, and the day hand 3 moves to the position pointing to SUN in FIG. 3.

When the day star wheel 220 turns the 24:00 detection switch lever 310 also turns, and the contact state of the 24:00 detection switch lever 310 and 24:00 detection pin 320 changes to the discontinuity state. When the day star wheel 220 then turns a specific angle, the 24:00 detection switch lever 310 rotates back to the original position, the contact state of the 24:00 detection switch lever 310 and 24:00 detection pin 320 changes to the continuity state, and the 24:00 detection signal is input to the control circuit unit. When the control circuit unit recognizes input of the 24:00 detection signal from the 24:00 detection pin 320, it applies the drive voltage and causes the actuator 101 to drive.

As a result, drive power from the actuator 101 is passed through the rotor 140 and rotor transfer wheel 150 to the control wheel 160, and the control wheel 160 turns. Rotation of the control wheel 160 causes the date changing detection switch lever 330 to turn, and the contact state of the date changing detection switch lever 330 and date changing detection pin 340 changes to the discontinuity state. When the drive power of the actuator 101 causes the control wheel 160 to turn 360/31 degrees, the date changing detection switch lever 330 pivots again to the control wheel 160 side, the contact state of the date changing detection switch lever 330 and date changing detection pin 340 changes to the continuity state, and the off voltage is input to the control circuit unit. When the control circuit unit recognizes input of the off voltage, it stops applying voltage to the actuator 101.

As a result, the control wheel 160 turns 360/31 degrees, that is, one day, clockwise. Rotation of the control wheel 160 also causes the ones intermediate wheel 170 that meshes with the ones control wheel 163 to rotate 60 degrees clockwise, and the tens intermediate wheel 180 that meshes with the tens control wheel 162 to rotate 60 degrees counterclockwise.

Note that both the ones intermediate wheel 170 and tens intermediate wheel 180 rotate because "09" is displayed as the date in this example, but if "31" is displayed as the date, the ones intermediate wheel 170 does not turn and "1" remains displayed as the ones digit in the ones digit window 41 because the ones control wheel 163 is not meshed with the ones intermediate wheel 170. Furthermore, if any date from 01 to 08, 10 to 18, 20 to 28, or 30 is displayed, the tens intermediate wheel 180 does not turn because the tens control wheel 162 is not meshed with the tens intermediate wheel 180, and the tens digit displayed in the tens digit window 42 does not change.

Rotation of the ones intermediate wheel 170 also transfers drive power to the ones indicator pinion 113, and the ones indicator wheel 110 turns. At this time the ones intermediate wheel 170 causes the ones indicator pinion 113 to turn two teeth of the ones intermediate gear 171. The ones indicator wheel 110 is thus driven counterclockwise 36 degrees ((360/20)*2 degrees). As a result, the "0" that is clockwise adjacent to the one digit "9" of the ones indicator plate 111 moves to the position in the ones digit window 41.

Rotation of the tens intermediate wheel 180 also transfers drive power to the tens indicator pinion 123 and causes the tens indicator wheel 120 to turn. At this time the tens intermediate wheel 180 drives the tens indicator pinion 123 the distance of two teeth of the tens intermediate gear 181. As a result, the tens indicator wheel 120 is rotated clockwise 90 degrees (45*2 degrees). The tens indicator tabs 121A counterclockwise adjacent to the tens indicator tabs 121A on which the tens digit "0" is printed on the tens indicator plate 121 moves to the twelve o'clock position, and the tens digit "1" is displayed in the tens digit window 42.

The timekeeping unit of the control circuit unit counts the time and the date. When the timekeeping unit of the control circuit unit counts the date as March 30, June 30, September 30, or November 30, it adjusts the date by driving the control wheel 160 (360/31)*2 degrees the next time it drives the calendar mechanism 100. In addition, when the date is February 28 (or February 29 in a leap year), the control circuit unit adjusts the date by driving the control wheel 160 (360/31)*4 degrees ((360/31)*5 degrees in leap years).

Effect of the Timepiece

As described above, the ones indicator wheel 110 of the timepiece 1 according to this embodiment of the invention has a ones indicator pinion 113 that is a ring-shaped external tooth wheel, and the tens intermediate gear 181 of the tens intermediate wheel 180 and the tens indicator pinion 123 of the tens indicator wheel 120 are disposed on the inside circumference side of the ones indicator pinion 113. The tens intermediate gear 181 and tens indicator pinion 123 are disposed within the thickness of the ones indicator pinion 113 in the timepiece thickness direction.

As a result, the ones indicator pinion 113, tens indicator pinion 123, and tens intermediate gear 181 do not overlap in the timepiece thickness direction and increase the timepiece thickness, and a thin timepiece 1 can thus be achieved.

Furthermore, if the ones indicator pinion 113 is rendered as an internal tooth wheel, other gears must be rendered inside, the diameter of the wheel increases, and the area for printing the ones date scale on the ones indicator becomes smaller. By rendering the ones indicator pinion 113 as an external tooth wheel in the timepiece 1 according to this embodiment of the invention, the diameter of the ones indicator pinion 113 can be decreased and an area that is wide enough to print the ones date scale 111A on the ones indicator plate 111 can be assured. Large ones digits can therefore be displayed in the calendar unit 40, and a calendar display that is easier to read can be provided.

The ones indicator wheel 110 is supported rotatably on an eccentric point P that is eccentric by a specific distance toward the axis of rotation of the tens intermediate wheel from the axis of rotation O of the hand shaft 11.

Compared with a configuration in which the ones indicator wheel 110 is supported on the axis of rotation O of the hand shaft 11, the inside diameter of the ones indicator pinion 113 can be decreased by a maximum of the outside dimension L3 of the tens intermediate wheel 180. The outside diameter of the ones indicator wheel 110 can therefore be reduced while keeping the width of the ones indicator plate 111 where the ones date scale 111A is disposed the same size as when the ones indicator wheel 110 and tens indicator wheel 120 are concentrically disposed.

Furthermore, because the outside diameter of the ones indicator plate 111 becomes smaller, the area of direct exposure between the main plate 20 and dial 4 is larger, and this area can be used to easily render the shaft supporting the day hand 3 projecting towards the dial 4 or shafts supporting other hands, and to dispose members linking the movement 10 and the dial 4.

More specifically, area sufficient to provide the numbers of the ones date scale can be assured while the additional space made available can be effectively used to improve the functionality and manufacturability of the timepiece 1.

As also described above, the calendar unit 40 is rendered near the twelve o'clock position of the timepiece 1, and the ones indicator wheel 110 is supported rotatably on an axis of rotation at an eccentric point P offset to the three o'clock position.

By rendering the calendar unit 40 near twelve o'clock, the ones digit window 41 and tens digit window 42 can be located along the circumference of the timepiece 1. Compared with rendering the calendar unit 40 near three o'clock or nine o'clock, this configuration makes reading the date easier. More particularly, the timepiece 1 according to this embodiment of the invention has a big date display with a ones digit window 41 and a tens digit window 42. If the calendar unit 40 is located near three o'clock or nine o'clock in this type of timepiece 1 so that the ones digit window 41 and tens digit window 42 are side by side in the radial direction of the timepiece, such as at the three o'clock position, the tens digits are near the hand shaft 11 and the date is difficult to read. By disposing the calendar unit 40 near twelve o'clock as in the timepiece 1 according to this embodiment of the invention, however, the size of the ones digit window 41 and tens digit window 42 can be increased and the date can be made easier to read.

Furthermore, because the ones indicator wheel 110 is disposed offset toward three o'clock, the calendar unit 40 can be disposed at a well-balanced position in the dial 4 without the ones digits of the ones date scale 111A becoming small. For example, if the ones indicator wheel 110 is set eccentrically towards the twelve o'clock position, the entire ones indicator wheel 110 also moves toward twelve o'clock, the calendar unit 40 must also be shifted toward the outside edge of the dial 4, resulting in unbalanced positioning and impaired styling. Furthermore, if the calendar unit 40 is disposed midway between the outside edge of the dial 4 and the timepiece center, the center hole 112 becomes shifted toward twelve o'clock, the area available for disposing the ones date scale 111A in the ones digit window 41 becomes smaller, and the date cannot be displayed with large numbers.

The position of the calendar unit 40 becomes similarly unbalanced if the ones indicator wheel 110 is set eccentrically towards six o'clock, and the area available for disposing the ones date scale 111A in the ones digit window 41 is reduced if the calendar unit 40 is set midway between the outside edge of the dial 4 and the timepiece center because the outside edge of the ones indicator plate 111 gets shifted towards twelve o'clock.

However, when the ones indicator wheel 110 is set eccentrically towards three o'clock, the date can be displayed with large numbers in the calendar unit 40 disposed between the outside edge of the dial 4 and the timepiece center.

The ones indicator wheel 110 is disposed toward three o'clock eccentrically to the tens indicator wheel 120, and the ones digit window 41 and tens digit window 42 are both disposed near twelve o'clock with the ones digit window 41 on the right side of twelve o'clock and the tens digit window 42 beside it to the left. This configuration enables displaying and forming the digits (0-9) on the ones date scale 111A of the ones indicator plate 111 that appear in the ones digit window 41 larger.

More specifically, if the ones digit window 41 is disposed on the right side substantially at twelve o'clock and the ones indicator wheel 110 is disposed on the left side (such as at a position where the axis of rotation is concentric to the axis of rotation of the hand shaft), in order to display the digits of the date on the ones date scale 111A in the ones digit window 41, the digits of the date must be arranged in an arc radiating from the axis of rotation of the ones indicator wheel 110, that is, on a slope at a specific angle to the radius of the ones indicator plate 111. If the digits are arranged circumferentially to the ones indicator plate 111 in this configuration, there will be places that overlap the adjacent date numerals, and the size of the date numerals cannot be sufficiently increased.

In the timepiece 1 according to this embodiment of the invention, the ones indicator wheel 110 is offset from the tens indicator wheel 120 towards three o'clock, that is, to the right side of the tens indicator wheel 120 as shown in FIG. 4 and FIG. 6, and the ones digit window 41 is likewise set to the right side of the tens digit window 42. In order to display the date numerals on the ones date scale 111A in the ones digit window 41 with this configuration, the date numerals can simply be arranged radiating from the axis of rotation of the ones indicator plate 111, or more particularly the date numerals can be on radii of the ones indicator plate 111. As a result, the date numerals can be disposed largest around the circumference of the ones indicator plate 111.

It should be noted that the tens digit window 42 is disposed on the left side of the axis of rotation of the tens indicator wheel 120 (the axis of rotation of the hand shaft), but because the date numerals on the tens date scale 121B of the tens indicator plate 121 are few (four in FIG. 11), the date numerals on the tens date scale 121B of the tens indicator plate 121 can be rendered large.

The ones intermediate wheel 170 and control wheel 160 are disposed outside the ones indicator pinion 113. The control wheel 160 is ring shaped, has the tens control wheel 162, which is an external tooth wheel, rendered around the outside, and has the ones control wheel 163, which is an internal tooth wheel, rendered around the inside circumference.

Therefore, compared with a configuration in which the tens control wheel and the ones control wheel are both rendered around either the inside circumference or the outside circumference of the control wheel 160, the thickness of the control wheel can be suppressed. In addition, the ones intermediate gear 171 and the tens intermediate gear 181 can be disposed at substantially the same height in the timepiece thickness direction. In other words, the thickness of the control wheel 160 can be reduced, the ones intermediate gear 171 and tens intermediate gear 181 can be disposed at substantially the same height without overlapping, the thickness of the timepiece 1 can therefore be reduced, and a thin timepiece 1 can be rendered.

The timepiece 1 has a drive motor disposed in the hand drive mechanism for driving the hands 2, and an actuator 101 as a date wheel drive power source disposed in the calendar mechanism for driving the ones indicator wheel 110 and tens indicator wheel 120.

More specifically, when both the hands 2 and calendar mechanism 100 are driven by the hand drive mechanism, high drive power is required to drive both the hands 2 and calendar mechanism 100, and more power is required to drive the drive motor because drive power must be supplied to drive the hands 2 even when the ones indicator wheel 110 and tens indicator wheel 120 do not move. With the configuration of the timepiece 1 described above, however, power consumption can be reduced because a drive motor producing the least amount of drive power needed to drive the hands 2 can be used as the hand drive motor.

When the control circuit unit detects from the signal from the 24:00 detection pin 320 that 24 hours have passed, the control circuit unit drives the actuator 101, and when it detects from the signal from the date changing detection pin 340 that the control wheel 160 has turned 360/31 degrees, it stops driving the actuator 101. As a result, the calendar mechanism 100 can be operated in conjunction with operation of the hand drive mechanism even when there are two drive power sources, and the date of the calendar can be reliably advanced one day every 24 hours with no deviation between changing the date and changing the time indicated by the hands.

The ones jumper 117 engages the ones indicator pinion 113 of the ones indicator wheel 110, and the tens jumper 118 engages the jumper engaging part 122 of the tens indicator wheel 120.

As a result, problems caused by the ones indicator wheel 110 or tens indicator wheel 120 turning as a result of external shock can be prevented.

Other Embodiments

The invention is not limited to the embodiment described above and variations and improvements with the scope of the accompanying claims achieving the same object are included in the invention.

Figure 1A:
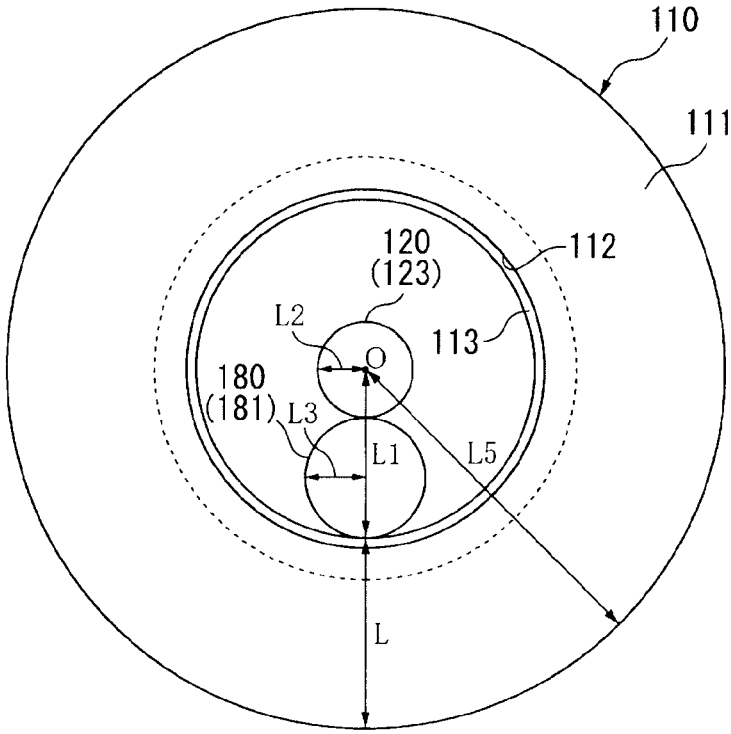
FIGS. 1A and 1B show the differences in the inside diameter of the ones indicator pinion due to the locations of the ones indicator wheel, tens indicator wheel, and tens intermediate wheel, with FIG. 1A showing the axis of rotation of the ones intermediate wheel and the axis of rotation of the tens intermediate wheel concentrically disposed, and FIG. 1B showing the axis of rotation of the ones intermediate wheel disposed to an eccentric position offset a specific direction from the axis of rotation of the tens intermediate wheel.
Figure 1B:
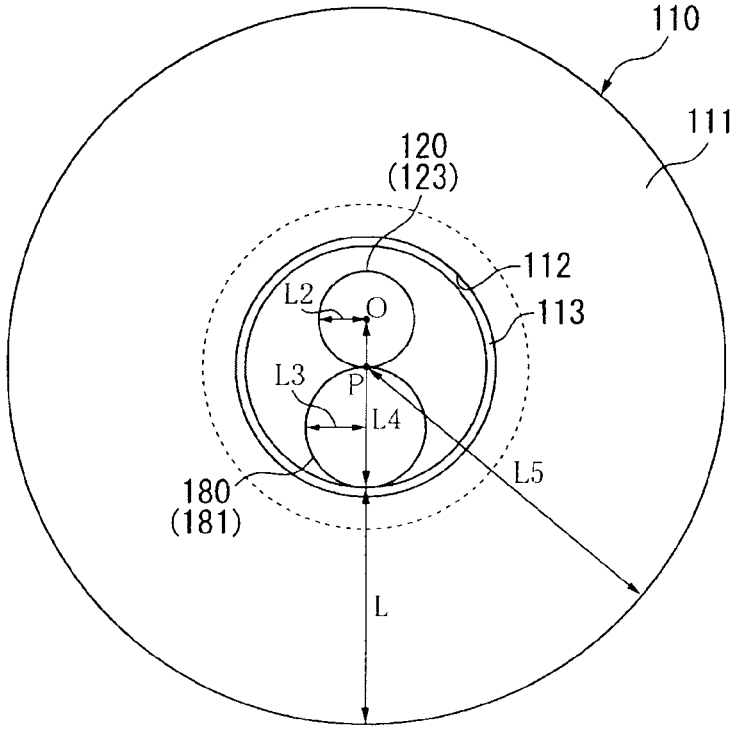
Figure 2A:
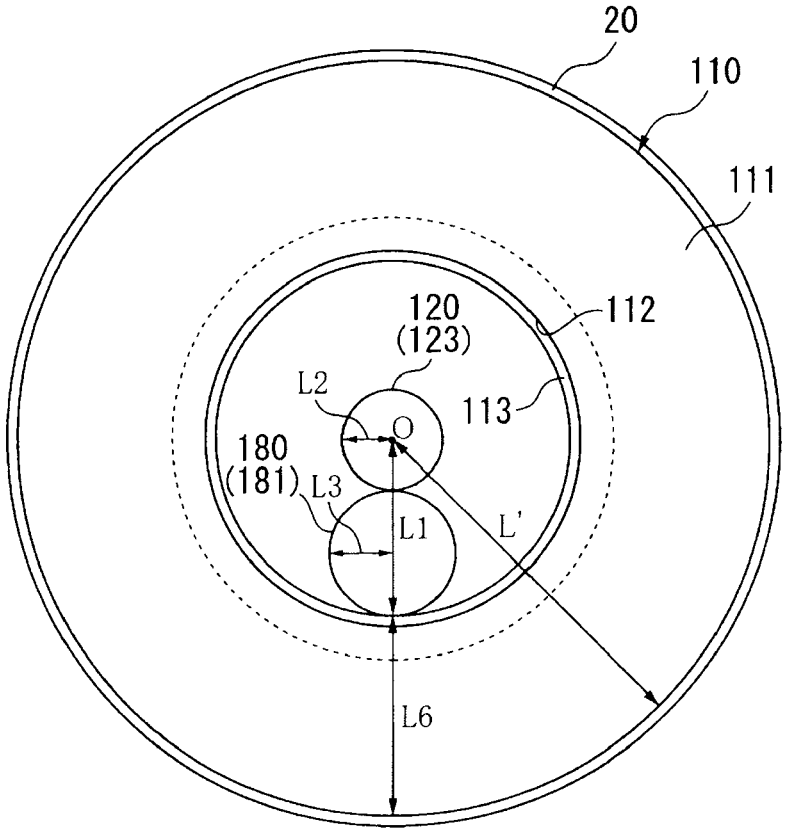
FIGS. 2A and 2B show the differences in the inside diameter of the ones indicator pinion due to the locations of the ones indicator wheel, tens indicator wheel, and tens intermediate wheel, with FIG. 2A showing the axis of rotation of the ones intermediate wheel and the axis of rotation of the tens intermediate wheel concentrically disposed, and FIG. 2B showing the axis of rotation of the ones intermediate wheel disposed to an eccentric position offset a specific direction from the axis of rotation of the tens intermediate wheel.
Figure 2B:
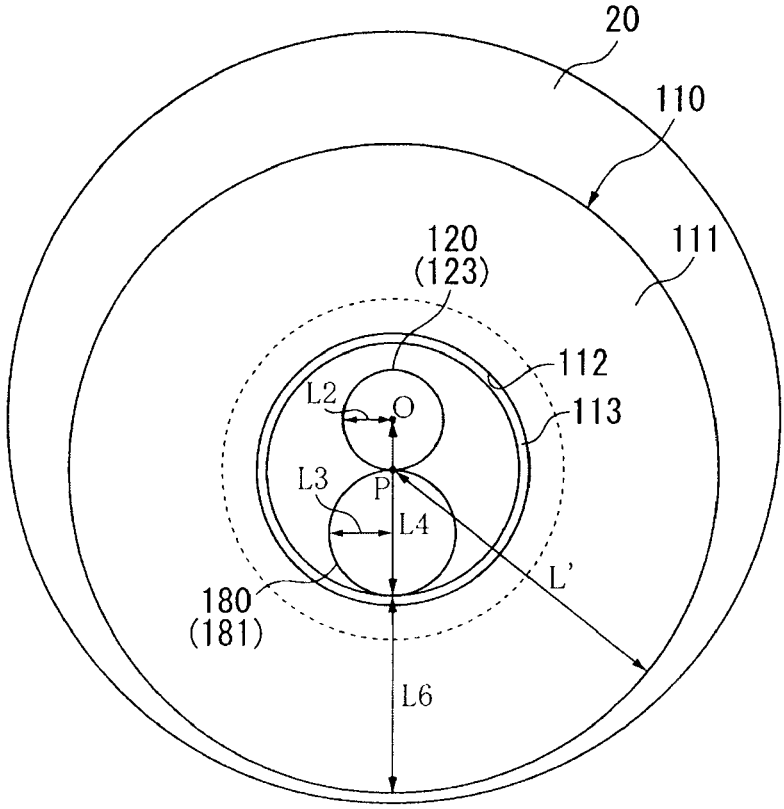

For example, a wristwatch type timepiece 1 is described in the foregoing embodiment and it is therefore necessary for the design to fit the ones indicator plate 111 within the diameter of the main plate 20, but the ones indicator plate 111 may be larger than the main plate 20 in a table clock, for example. In this case, as shown in FIG. 1, by disposing the axis of rotation of the ones indicator wheel 110 at an eccentric position offset a specific distance from the axis of rotation O of the hand shaft 11, the distance from the center hole 112 of the ones indicator plate 111 to the outside edge can be made greater than when the ones indicator wheel 110 and tens indicator wheel 120 are disposed concentrically to the axis of rotation O of the hand shaft 11, and a ones date scale 111A with even larger ones numerals can be rendered. Furthermore, in a table clock and other timepieces for which a thin design is not necessary, configurations in which the battery overlaps the control wheel or the 24-hour wheel, and configurations in which part of the drive power transfer wheel train 130, part of the day hand driving mechanism, and the battery, for example, overlap are also conceivable.

A timepiece 1 having two drive power sources, a drive motor and an actuator 101, is described above, but a configuration in which the control wheel 160 is rotationally driven by the hour wheel 14 through a rotor intermediate wheel is also conceivable. Because the drive motor can drive the calendar mechanism 100 in this situation, the actuator 101, 24:00 detection switch lever 310, 24:00 detection pin 320, date changing detection switch lever 330, and date changing detection pin 340 are rendered unnecessary and the configuration can be simplified.

The spring constant of the 24:00 detection switch lever 310 and the date changing detection switch lever 330 may also be adjusted so that they can function as jumpers for the day star wheel 220 and control wheel 160. This configuration can prevent rotation of the control wheel 160 and rotation of the day star wheel 220 caused by external shock.

The ones indicator wheel 110 is disposed eccentrically towards three o'clock, but a configuration having the ones indicator wheel disposed eccentrically toward nine o'clock is also conceivable. The calendar unit 40 is also not limited to a twelve o'clock position, and may be rendered at six o'clock, for example. If the calendar unit 40 is near the six o'clock position, the ones indicator wheel 110 is preferably disposed eccentrically to the tens indicator wheel 120 near three o'clock. This is because the ones digit window 41 of the calendar unit 40 is also located on the right side of the tens digit window 42 (the three o'clock side) in this configuration.

A configuration in which the axis of rotation of the ones indicator wheel 110 is rendered eccentrically is described above, but the axis of rotation of the ones indicator wheel 110 may like the tens indicator wheel 120 also be rendered concentrically to the axis of rotation of the hand shaft 11. This configuration enables further increasing the area of the ones indicator plate 111.

The calendar unit 40 is rendered with the ones digit window 41 and tens digit window 42 separated as shown in FIG. 3 in the embodiment described above, but the ones digit window 41 and tens digit window 42 may be joined as a single window. More specifically, the calendar unit 40 may be rendered with the ones digit window 41 and tens digit window 42 joined in a single large window, and one of the ones numerals on the ones date scale 111A of the ones indicator wheel 110 can be displayed beside one of the tens numerals on the tens date scale 121B of the tens indicator wheel 120 in the single window of the calendar unit 40.

Furthermore, the calendar unit 40 is described as being located near twelve o'clock as shown in FIG. 3 or near six o'clock, but the invention is not limited to these locations. For example, the calendar unit 40 may be located at approximately three o'clock. Referring to FIG. 4, for example, the tens digit window 42 in this configuration is disposed between the hand shaft 11 and approximately three o'clock, and the ones digit window 41 is disposed on the outside circumference side of the tens digit window 42 at approximately three o'clock. One of the tens numerals on the tens date scale 121B of the tens indicator plate 121 is displayed in the tens digit window 42, and one of the ones numerals on the ones date scale 111A of the ones indicator wheel 110 is displayed in the ones digit window 41. The user can thus read the date at approximately the three o'clock position with one of the tens numerals on the tens date scale 121B on the left side and one of the ones numerals on the ones date scale 111A on the right side of the tens digit.

The tens control wheel 162 is formed around the outside edge and the ones control wheel 163 is formed around the inside edge of the control wheel 160 in the foregoing embodiment, but the invention is not so limited. For example, the tens control wheel 162 may be rendered on the dial 4 side of the outside edge of the control wheel 160, and the ones control wheel 163 may be disposed on the back cover side. In this configuration the drive power transfer wheel 161 that meshes with the rotor transfer wheel 150 may be formed along the inside circumference edge of the control wheel 160.

In the foregoing embodiment the ones indicator pinion 113 is an external tooth wheel that is ring shaped and has external teeth formed around the outside circumference, and the tens indicator pinion 123 and the tens intermediate wheel 180 that meshes with the tens indicator pinion 123 and transfer drive power are disposed in the space on the inside circumference side of the ones indicator pinion 113, but the locations of the ones indicator pinion 113 and tens indicator pinion 123 may be reversed.

In this configuration the tens indicator pinion is a ring-shaped external tooth wheel with external teeth formed around the outside circumference and is disposed in a position equivalent to the location of the ones indicator pinion in the foregoing embodiment, and the ones indicator pinion and the ones intermediate wheel that meshes with the ones indicator pinion and transfer drive power are located in the space on the inside circumference side of the tens indicator pinion. The ones indicator pinion and the hand shaft 11 are disposed concentrically. With this configuration the parts from the actuator 101 to the control wheel 160 are basically configured as described in the preferred embodiment described above, the internal teeth of the control wheel 160 mesh with the tens indicator pinion of the tens intermediate wheel comparable to the ones intermediate wheel in the foregoing embodiment, and the tens intermediate gear of the tens intermediate wheel meshes with the tens indicator pinion and the tens indicator wheel is driven.

The external teeth of the control wheel 160 mesh with the ones intermediate pinion of the ones intermediate wheel comparable to the tens intermediate pinion of the tens intermediate wheel, and the ones indicator wheel is driven rotationally by the ones intermediate gear of the ones intermediate wheel meshing with and driving the ones indicator pinion. Note that the gear ratios are changed from the foregoing embodiment, but as in the foregoing embodiment the ones indicator fundamentally turns one step per day and the tens indicator turns one step in ten days. Furthermore, because the ones indicator wheel 110 is disposed on the dial side and the tens indicator plate 121 is disposed on the back cover side in this configuration, which is the opposite of the configuration in the thickness direction described in the foregoing embodiment, a plurality of windows enabling one of the markers in the tens date scale 121B to be seen must be formed between adjacent markers in the ones date scale 111A circumferentially to the ones indicator wheel 110.

Furthermore, a day display unit for displaying the day of the week is described in the foregoing embodiment as the fan-shaped information display unit, but the invention is not so limited. For example, other information that may be displayed on the fan-shaped information display unit includes the month or year. If configured to display the month or year, month display markers are disposed as the information display scale dividing the fan-shaped display area into twelve parts at a specific angle, and a month hand is caused to rotate as the information hand through the month display markers. In a configuration that displays the year, year display markers are disposed as the fan-shaped information display scale in which the ones digit of the year is displayed, and a year hand is caused to rotate as the information hand through the year display markers.

Further alternatively, the mechanism 200 rendered as the fan-shaped information display unit may be a time display such as a seconds dial using a seconds hand or a chronograph dial using a chronograph hand, or it may be used to display non-time information, such as a hand indicating how much power is left in the timepiece battery, or hands indicating external information, such as the temperature, barometric pressure, or humidity. In such configurations sensors for measuring specific properties and a dedicated drive means for driving the fan display hand are disposed inside the timepiece.

The fan-shaped information display unit represented by the main plate 20 described above is described as being driven by drive power from the drive motor of the hand drive mechanism, but the invention is not so limited. For example, the fan-shaped information display unit may be driven by drive power from the actuator 101, in which case the day can be changed and the date can be changed at the same timing by driving the day hand drive mechanism 200 simultaneously to the rotation timing of the ones indicator wheel 110.

If the month or year is displayed in the fan-shaped display when thus configured, the display can be easily controlled in conjunction with the calendar mechanism 100. For example, controlling driving the information hand can be simplified by driving the information hand when the tens digit of the date changes from "3" to "1".

Furthermore, while the calendar unit 40 is disposed near the twelve o'clock position of the timepiece 1 and the day display unit is disposed near six o'clock, the calendar unit 40 may be disposed near the six o'clock position and the day display unit is disposed near twelve o'clock.

The crown 6 and stem 6A may also be disposed at three o'clock.

The specific configuration and sequences of the embodiment described above can also be changed suitably to accommodate other structures without departing from the scope of the accompanying claims and still achieving the object of the invention.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A timepiece comprising:

a dial having a tens date display window for displaying the tens digit of the date, and a ones date display window for displaying the ones digit of the date; and a calendar mechanism having a tens indicator wheel to which a plurality of tens digit markers are disposed and a ones indicator wheel to which a plurality of ones digit markers are disposed, and which displays one of the plural tens digit markers disposed to the tens indicator wheel from the tens date display window, and displays one of the plural ones digit markers disposed to the ones indicator wheel from the ones date display window;

the ones indicator wheel having a ones indicator plate on which the ones digit markers are disposed, and a ones indicator pinion affixed to the ones indicator plate;

the tens indicator wheel having a tens indicator plate on which the tens digit markers are disposed, and a tens indicator pinion affixed to the tens indicator plate;

the ones indicator pinion being a ring-shaped external tooth wheel having external teeth formed on the outside circumference surface; and the tens indicator pinion and a tens intermediate wheel that meshes with and transfers drive power to the tens indicator pinion being entirely disposed in the space on the inside circumference side of the ones indicator pinion.

2. The timepiece described in claim 1, wherein:

the axis of rotation of the ones indicator wheel is disposed to an eccentric position located in a specific direction from the axis of rotation of the tens indicator wheel.

3. The timepiece described in claim 1, further comprising:

a hand that indicates time; and a hand shaft that supports the hand;

wherein the axis of rotation of the hand shaft is disposed concentrically to the axis of rotation of the tens indicator wheel.

4. The timepiece described in claim 1, wherein:

the tens date display window and the ones date display window are disposed in the dial at approximately the twelve o'clock direction or approximately the six o'clock direction from the axis of rotation of the hand shaft; and the axis of rotation of the ones indicator wheel is disposed to an eccentric position located in a specific distance from the axis of rotation of the hand shaft toward approximately the three o'clock position or approximately the nine o'clock position of the dial.

5. The timepiece described in claim 1, further comprising:

a hand that indicates time; and a hand shaft that supports the hand;

wherein the hand shaft is disposed in a space on the inside circumference side of the ones indicator pinion and concentrically to the tens indicator pinion.

6. The timepiece described in claim 1, further comprising:

a ones intermediate wheel that meshes with the ones indicator pinion and transfers drive power to the ones indicator wheel; and a control wheel that transfers drive power from a date wheel drive power source to the tens intermediate wheel and the ones intermediate wheel, the control wheel being ring shaped with external teeth disposed to the outside circumference surface and internal teeth disposed to the inside circumference surface, the external teeth of the control wheel meshing with a pinion of the tens intermediate wheel, and the internal teeth of the control wheel meshing with a pinion of the ones intermediate wheel.

7. The timepiece described in claim 1, further comprising:

a hand drive power source that supplies drive power to drive the hand supported on the hand shaft; and a date wheel drive power source that supplies drive power to drive the ones indicator wheel and the tens indicator wheel.

* * * * *